US007269975B2

(12) United States Patent
Miyamoto et al.

(10) Patent No.: US 7,269,975 B2
(45) Date of Patent: Sep. 18, 2007

(54) CAM APPARATUS FOR KNITTING FABRIC

(75) Inventors: Masaki Miyamoto, Wakayama (JP); Hiroshi Maeda, Wakayama (JP); Takuya Miyai, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/574,938

(22) PCT Filed: Oct. 7, 2004

(86) PCT No.: PCT/JP2004/014861

§ 371 (c)(1),
(2), (4) Date: Apr. 7, 2006

(87) PCT Pub. No.: WO2005/035852

PCT Pub. Date: Apr. 21, 2005

(65) Prior Publication Data

US 2007/0051138 A1 Mar. 8, 2007

(30) Foreign Application Priority Data

Oct. 10, 2003 (JP) ..... 2003-352984

(51) Int. Cl.
*D04B 15/36* (2006.01)

(52) U.S. Cl. ..... 66/78

(58) Field of Classification Search ..... 66/71, 66/75.1, 78, 76, 77

See application file for complete search history.

(56) References Cited

U.S. PATENT DOCUMENTS 4,474,037 A 10/1984 Kühnert
4,545,219 A * 10/1985 Schmodde ..... 66/70
4,643,003 A * 2/1987 Schmodde ..... 66/78
4,729,230 A * 3/1988 Schmodde et al. ..... 66/70
5,343,719 A 9/1994 Nakamori et al.
6,018,966 A 2/2000 Shima
6,047,569 A 4/2000 Shima
6,079,231 A 6/2000 Shima
6,125,661 A 10/2000 Shima
6,178,782 B1 * 1/2001 Takeda et al. ..... 66/64

FOREIGN PATENT DOCUMENTS

EP 0751248 A1 1/1997

(Continued)

*Primary Examiner*—Danny Worrell
(74) *Attorney, Agent, or Firm*—Harness, Dickey & Pierce, P.L.C.

(57) ABSTRACT

On each of carriages are disposed a group of transfer cams and a group of receiving cams. A leftward movement of the carriages makes it possible to transfer a knitted loop from a front needle bed provided with one carnage to a rear needle bed provided with another carriage. A rightward movement of the carriages makes it possible to transfer the knitted loop from the rear needle bed provided with the other carriage to the front needle bed provided with one carriage. The transferring can be freely carried out between the needle beds, and it is possible to temporarily place a knitted loop from one needle bed to another needle bed and keep a holding, and further retain the knitted loop separately from a fabric being knitted on the other needle bed and when needed, return the knitted loop from the other needle bed to the one needle bed.

4 Claims, 23 Drawing Sheets

FOREIGN PATENT DOCUMENTS

| | | | |
|---|---|---|---|
| GB | 2072713 | A | 10/1981 |
| JP | 61-20670 | B2 | 5/1986 |
| JP | 62-19535 | B2 | 4/1987 |
| JP | 9-21039 | A | 1/1997 |
| JP | 2700203 | B2 | 1/1998 |
| JP | 2917146 | B2 | 7/1999 |
| JP | 2946325 | B2 | 7/1999 |
| JP | 2995464 | B2 | 12/1999 |
| JP | 3292836 | B2 | 6/2002 |

* cited by examiner

CAM APPARATUS FOR KNITTING FABRIC

TECHNICAL FIELD

The invention relates to a cam apparatus for knitting a fabric, which is mounted on a carriage moving back and forth along a needle bed of a weft knitting machine and selectively drives a knitting needle disposed on the needle bed to perform an operation of knitting a fabric.

BACKGROUND ART

Conventionally, in a weft knitting machine, a large number of knitting needles are arranged on a needle bed, and a cam apparatus for knitting a fabric is mounted on a carriage moving along the needle bed. The carriage is driven in the cam apparatus for knitting a fabric so that a knitting needle selectively moves forward into and backward from a needle bed gap, and supplies a knitting yarn to a knitting needle at the needle bed gap, thereby knitting a fabric. At least a pair of the needle beds is often disposed at front and back. In a weft knitting machine in which at least a pair of the needle beds is disposed at front and back, a fabric is basically knitted at each needle bed. By use of the front and rear needle beds, it is possible to knit textures such as a rib stitch, and also knit a pouched fabric by knitting a fabric at each of the front and rear needle beds and making both ends in a width direction of the knitted fabrics continuous. Moreover, it is also possible to carry out a transferring that a knitted loop is made to move between front and rear needle beds (Refer to Japanese Examined Patent Publication JP-B2 2946325, JP-B2 2917146, JP-B2 2995464, and JP-B2 3292836, for example).

The Japanese Examined Patent Publication JP-B2 2946325 discloses a basic idea of a method for temporarily placing a knitted loop, by use of compound needles for the knitting needles on the front and rear needle beds, from the facing needle bed onto a tongue of a slider of the compound needle retaining a knitted loop on a hook of a needle body. The Japanese Examined Patent Publication JP-B2 2917146 discloses a knitted loop forming method for split-knitting, a cam structure for the method, and the like, in which method the compound needles are used for the knitting needles on the front and rear needle beds, and a knitted loop formed through previous course is not knocked over but retained on a tongue of a slider, and transferred to the knitting needle on the facing needle bed and further, both of racking for shifting the needle bed and the transferring are applied. The Japanese Examined Patent Publication JP-B2 2995464 discloses an apparatus for the transferring and the temporal placement of a knitted loop, in which apparatus the compound needles are used on the front and rear needle beds and further, separately from the front and rear needle beds, a transfer jack is provided. The cited reference 4 discloses a structure of a weft knitting machine using the compound needles for the knitting needles on the front and rear needle beds, by which apparatus the transferring and the split-knitting can be carried out.

According to the related art disclosed in the aforementioned Japanese Examined Patent Publications JP-B2 2946325, JP-B2 2917146, JP-B2 2995464, and JP-B2 3292836, by means of the weft knitting machine using the compound needles on the front and rear needle beds, it is possible to knit not only a basic fabric, but also various fabrics by inclusion of the transferring and the like. However, the Japanese Examined Patent Publication JP-B2 2946325 does not disclose specific structures such as a cam apparatus for effectively driving the knitting needles. According to the Japanese Examined Patent Publication JP-B2 2917146, the transferring knitted loop is received by a hook of a needle body on the facing needle bed, so that the method of temporarily placing a knitted loop as disclosed in the Japanese Examined Patent Publication JP-B2 2946325 cannot be applied.

The Japanese Examined Patent Publication JP-B2 2995464 discloses a cam structure for temporarily placing a knitted loop by use of a transfer jack, and a cam structure for temporarily placing a knitted loop, having a slider holding cam provided on a slider cam on the same phase of a transferring cam and a knitting cam. However, theses cam structures are complex.

Further, in a structure having a transfer cam disposed on a knitting cam, as shown in the Japanese Examined Patent Publications JP-B2 2995464 and JP-B2 3292836, a needle is selected to one of three positions of A, H, and B, at each position of which a presser is disposed, so that change-over between driving and non-driving of needle body, slider, or the like is carried out. Such a structure requires not only a complex cam structure, but also a raising cam having right and left apexes with long distance therebetween. Accordingly, such a structure is not suitable to a knitting machine for producing knitted products having a short knitted width such as a glove and a sock, for which knitting machine frequently repeats back-and-forth motions at a high speed because the structure would cause a larger time loss.

DISCLOSURE OF INVENTION

An object of the invention is to provide a cam apparatus for knitting a fabric, having a simple structure, which enables easy transferring and temporal placement of a knitted loop, and furthermore enables downsizing of a carriage.

The invention is a cam apparatus for knitting a fabric in a weft knitting machine having front and rear needle beds facing each other at a needle bed gap, the cam apparatus comprising:

a knitting cam mounted on a carriage moving along each of the needle beds, for acting on a needle body of a compound needle arranged on each of the carriages; and a slider cam mounted on a side of the carriage facing the needle bed gap, for acting on a butt of a slider and driving for knitting a fabric so that the slider is cooperated with the needle body driven by the knitting cam, wherein the cam apparatus comprises a group of transfer cams provided in series to the knitting cam on at least one of the carriages, and a group of receiving cams provided in series to the knitting cam on the carriage which is opposed at the needle bed gap to the carriage provided with the group of transfer cams, the group of transfer cams including:

a slider transfer raising cam disposed at an ending position of a cam route through which the butt of the slider is guided by the slider cam, the slider transfer raising cam being capable of control of change-over between driving and non-driving of the butt of the slider is carried out, and when change-over to driving of the slider is carried out, the slider transfer raising cam guiding the butt of the slider to convey the slider to a cam route in which a tongue of the slider advances farther toward the needle bed gap than a hook of the needle body does; and a transfer cam disposed on the cam route to which the butt of the slider is guided by the slider transfer raising cam, for driving the slider to advance to a transfer position where a knitted loop can be transferred at a farther advanced position toward the needle bed gap than a position advanced by the slider cam, and the group of receiving cams including:

a transfer-side knitted loop receiving cam disposed at a position facing the transfer cam of the group of transfer cams, the transfer-side knitted loop receiving cam being capable of control of change-over between driving and non-driving of the needle body, and when change-over to driving of the needle body is carried out, the transfer-side knitted loop receiving cam driving the needle body to convey a hook of the needle body to a knitted loop receiving position where a knitted loop can be received from the slider advancing to the transfer position by the transfer cam; and a slider receiving raising cam, with respect to movement of the carriage, disposed in a vicinity of a position where the driving of the needle body is started by the knitted loop receiving cam, the slider receiving raising cam being capable of controlling change-over between driving and non-driving of the butt of the slider, and when change-over to driving of the butt of the slider is carried out, the slider receiving raising cam guiding the butt of the slider to convey the slider to a receiving retention route for retaining the knitted loop in which a tongue of the slider advances farther toward the needle bed gap than a hook of the needle body does, wherein the group of transfer cams further include a transfer-side knitted loop transfer cam disposed at a position facing a receiving retention route through which the slider is guided by the receiving raising cam of the group of receiving cams, which transfer-side knitted loop transfer cams are capable of control of change-over between driving and non-driving of the needle body, and conveys the hook of the needle body independently or together with the slider to the knitted loop receiving position when change-over to driving of the needle body is carried out.

Further, the invention is characterized in that:

the compound needle is provided with a needle jack in order to be driven by the knitting cam to perform a knitting operation;

the butt of the slider is constituted so as to be sank into a needle groove and no longer subjected to driving from the group of receiving cams by moving the needle jack into the needle groove; and a needle jack guide cam and a presser are further included, the needle jack guide being provided in series to the group of receiving cams and more outwardly from the knitting cam having a pressing slope for pressing a butt of the needle jack so as to move the butt of the slider into the needle groove, and a cam face for guiding the butt of the needle jack to the pressing slope so that the butt of the slider passes through the group of transfer cams, the presser being selectively capable of pressing the needle jack so as to pass the needle jack without engaging with the cam face of the needle jack guide cam.

Further, the invention is characterized in that the group of transfer cams and the group of receiving cams are respectively provided on the carriages which are respectively disposed on the front and rear needle beds.

Further, the invention is characterized in that each of the carriages further comprises:

a knitting cam for execution of one knitting operation;

a needle selection mechanism disposed on two sides of the knitting cam with respect to a moving direction of the carriage, the needle selection mechanism performing a needle selection operation for selecting a needle to one position among different three control positions; and a movable presser disposed at one position of three positions, the movable presser being capable of controlling the knitting operation.

BRIEF DESCRIPTION OF DRAWINGS

Other and further objects, features, and advantages of the invention will be more explicit from the following detailed description taken with reference to the drawing wherein.

BEST MODE FOR CARRYING OUT THE INVENTION

Figure 1:
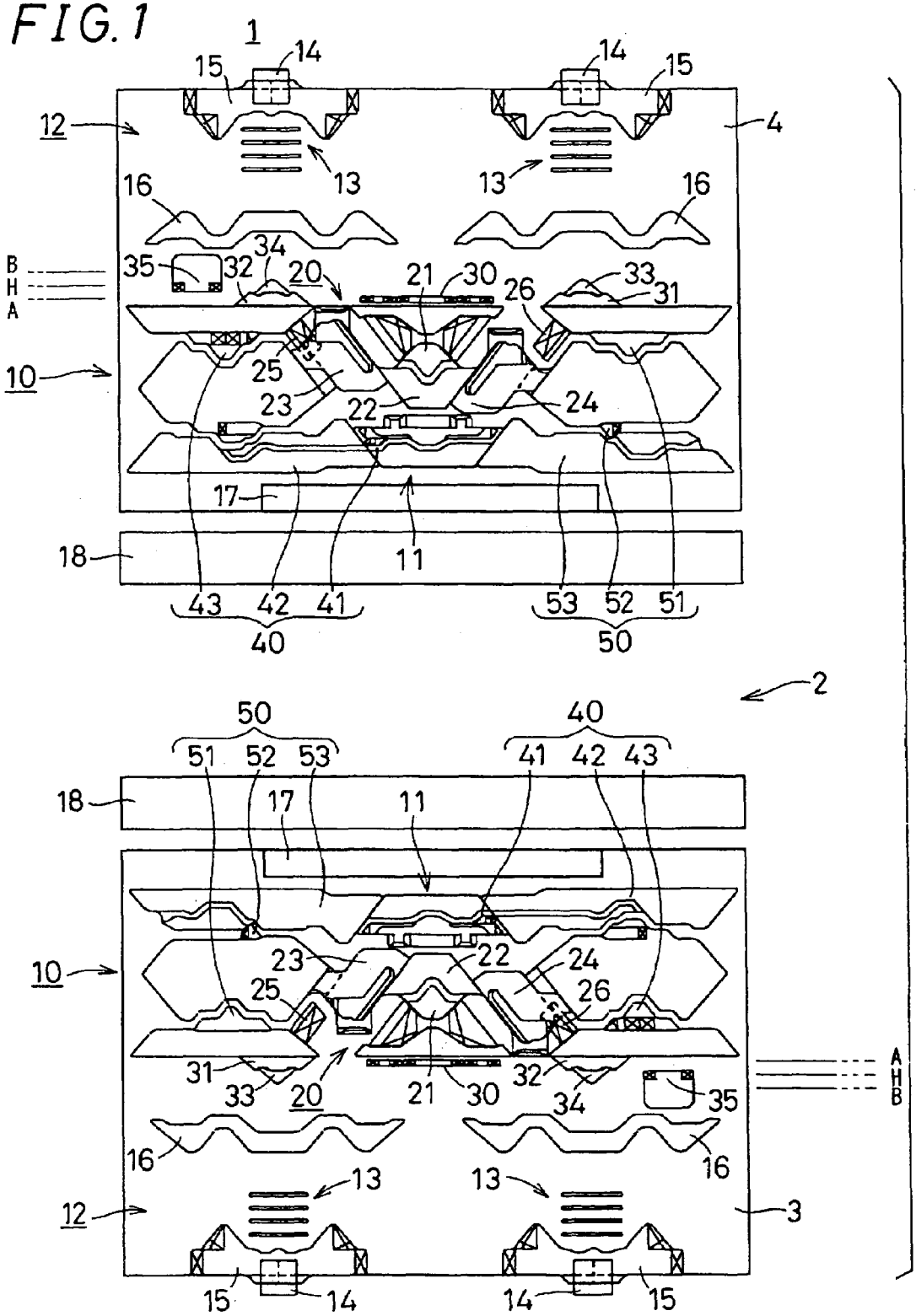
FIG. 1 is a schematic cam layout of a cam apparatus 1 for knitting a fabric according to one embodiment of the invention.

Now referring to the drawings, preferred embodiments of the invention are described in detail below.

FIG. 1 is a schematic cam layout of a cam apparatus 1 for knitting a fabric according to one embodiment of the invention. This cam layout shows a side which receives effect of the cam, as seen through a top surface. The cam apparatus 1 for knitting a fabric is a weft knitting machine having front and rear needle beds facing each other at a needle bed gap, and mounted on carriages 3 and 4 which move along the respective needle beds. The carriage 3 moves along the front needle bed while the carriage 4 moves along the rear needle bed. The carriages 3 and 4 have the basically same constitution, comprising a needle body cam 10 and a slider cam 11 when using, as a knitting needle, a compound needle composed of a needle body and a slider. Knitting operation through a knitting needle can be selected for each needle by a needle selection mechanism 12. The needle selection mechanism 12 comprises a needle selection actuator 13, a selector float-up cam 14, a selector push-up cam 15, and a selector guide cam 16. In the respective carriages 3 and 4 are provided a yarn guide cam 17 for driving a movable sinker which presses a knitting yarn at the needle bed gap 2, a sinker cam 18 for guiding a knitting yarn to a knitting needle, and the like.

Note that the selector float-up cam 14 is shown in the cam layout for convenience sake of description although a function of the selector float-up cam 14 to push up a selector from a bottom side of a needle groove is effected at a position away from bottom boards of the carriages 3 and 4 as will be hereinafter described in detail. Moreover, as to the selector push-up cam 15, etc. except the selector float-up cam 14, a direction toward the needle bed gap 2 is indicated as "up" while a direction backward from the needle bed gap 2 is indicated as "down", respectively. Furthermore, in the selector float-up cam 14 and the like, a face shown in cross-hatched pattern indicates an inclined face which is continuously raised from a surface of the bottom board.

The needle body cam 10 comprises a knitting cam 20. The knitting cam 20 comprises a raising cam 21 including a center cam, and a guard cam 22 called as an upper cam, stitch cams 23 and 24, and the like. The raising cam 21 has a mountain-like shape protruding toward the needle bed gap 2. A guide path for moving a needle body to a knitting position is formed between the raising cam 21 and the guard cam 22 which is disposed closer to the needle bed gap 2 than the raising cam 21 is. The carriages 3 and 4 move back and forth in a horizontal direction of the figure. The stitch cams 23 and 24 are respectively disposed on both sides of the knitting cam 20 so that the needle body which has advanced toward the needle bed gap 2 can be dragged down in movement of the carriages in both directions. The stitch cams 23 and 24 can be relatively displaced along inclined faces of the mountain-like shape of the raising cam 21 so that a stitch density can be arranged by changing a dragged-down amount of the needle body.

With respect to moving directions of the carriages 3 and 4, rubber cams 25 and 26 are disposed around the raising cam 21 as a center therefor, respectively in outward directions from the stitch cams 23 and 24. The rubber cams 25 and 26 are control cams which can be displaced to be in and out of the bottom boards of the carriages 3 and 4. In a state where the rubber cams 25 and 26 protrude from the bottom board, it is possible to make an inlay stitch for which a stretch yarn is used. In the area where the knitting cam 20 is disposed, a movable presser 30 is disposed at a position receded from the needle bed gap 2. Outside the movable presser 30 are disposed select jack half stitch cams 31 and 32, and select jack stitch cams 33 and 34. The select jack half stitch cams 31 and 32 are fixed cams which always protrude from the bottom board. The select jack stitch cams 33 and 34 are control cams which can be displaced to be in and out of the bottom board. Outside the select jack stitch cam 34 is disposed a select jack presser 35.

Each of the carriages 3 and 4 is provided with a group of transfer cams 40 and a group of receiving cams 50. On the carriage 3, the group of transfer cams 40 are disposed at a downstream-side position to the knitting cam 20 in a case where the carriage 3 moves in one direction, for example leftward in the figure. On the carriage 4 facing the carriage 3 across the needle bed gap 2, the group of receiving cams 50 is disposed at a position facing the group of transfer cams 40. The group of transfer cams 40 and the group of receiving cams 50 are thus disposed. Accordingly, by moving the carriages 3 and 4 leftward, a knitted loop can be transferred from a front needle bed provided with the carriage 3 to a rear needle bed provided with the carriage 4.

Note that on the carriage 4, the group of transfer cams 40 are disposed at a position which corresponds to a position of the group of receiving cams 50 across the knitting cam 20. At the position of the carriage 3, facing the group of transfer cams 40 of the carriage 4 across the needle bed gap 2 is disposed the group of receiving cams 50. Consequently, when the carriages 3 and 4 are made to move in a right direction, a knitted loop can be transferred from the rear needle bed provided with the carriage 4 to the front needle bed provided with carriage 3.

Each of the group of transfer cams 40 includes a slider transfer raising cam 41, a slider transfer cam 42, and a transfer-side knitted loop receiving cam 43. The slider transfer cam 42 includes a cam route for maintaining a raised position of a slider toward the needle bed 2 caused by a slider cam 11, and further raising the slider. The slider transfer raising cam 41 is disposed between the slider cam 11 and the slider transfer cam 42. The slider transfer raising cam 41 is a control cam which can be displaced to be in and out of the bottom board. The slider transfer raising cam 41 in a protruding state conveys the slider to the cam route of the slider transfer cam 42. The transfer-side knitted loop receiving cam 43 is used for conveying the needle body independently or together with the slider, to the receiving position where a knitted loop is received from the opposed needle bed. The transfer-side knitted loop receiving cam 43 is also a control cam which can be displaced to be in and out of the bottom board. It is possible to take the knitted loop back which has been once transferred to the opposed needle bed side by making the transfer-side knitted loop receiving cam 43 protrude.

Each of the group of receiving cams 50 includes a receiving-side knitted loop receiving cam 51, a receiving-side retention raising cam 52, and a receiving slider cam 53. The receiving-side knitted loop receiving cam 51 is a control cam which can be displaced to be in and out of the bottom board. The receiving-side knitted loop receiving cam 51 is made to protrude, thereby advancing the needle body to the needle bed gap 2 so that the needle body is conveyed to the receiving position where the knitted loop to be transferred from the opposed needle bed is received. The receiving-side retention raising cam 52 is a control cam which can be displaced to be in and out of the bottom board. The receiving-side retention raising cam 52 is made to protrude, thereby guiding the slider to the receiving slider cam 53 and advancing the slider to the needle bed gap 2 so that the knitted loop to be transferred from the opposed needle bed is taken, and it is possible to keep the state where the knitted loop is retained.

Figure 2:
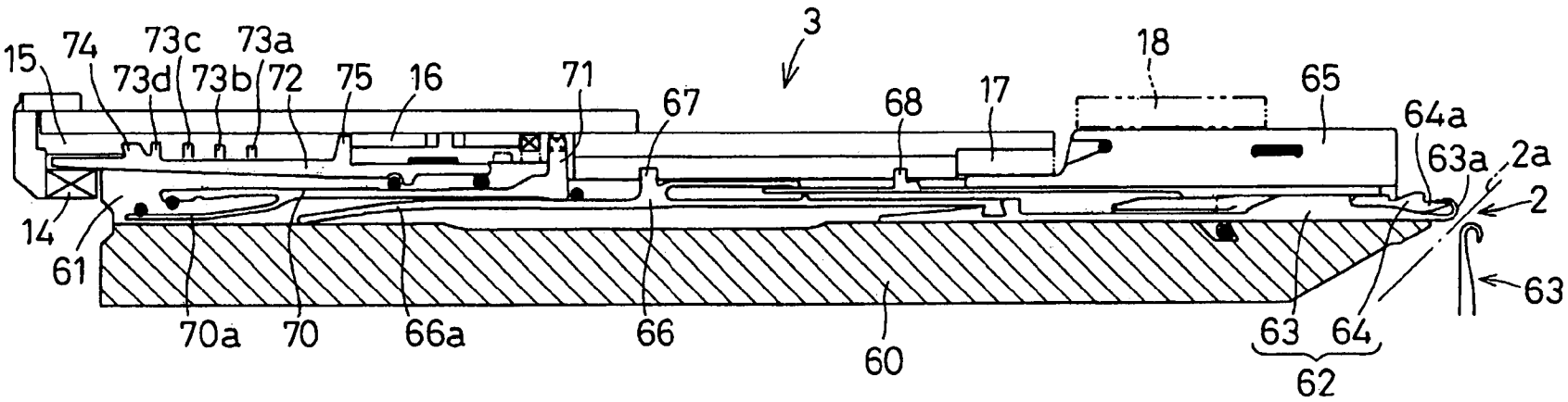
FIG. 2 is a section view showing a needle selection state where a select jack 70 is pushed up to a position A in FIG. 1.
Figure 3:
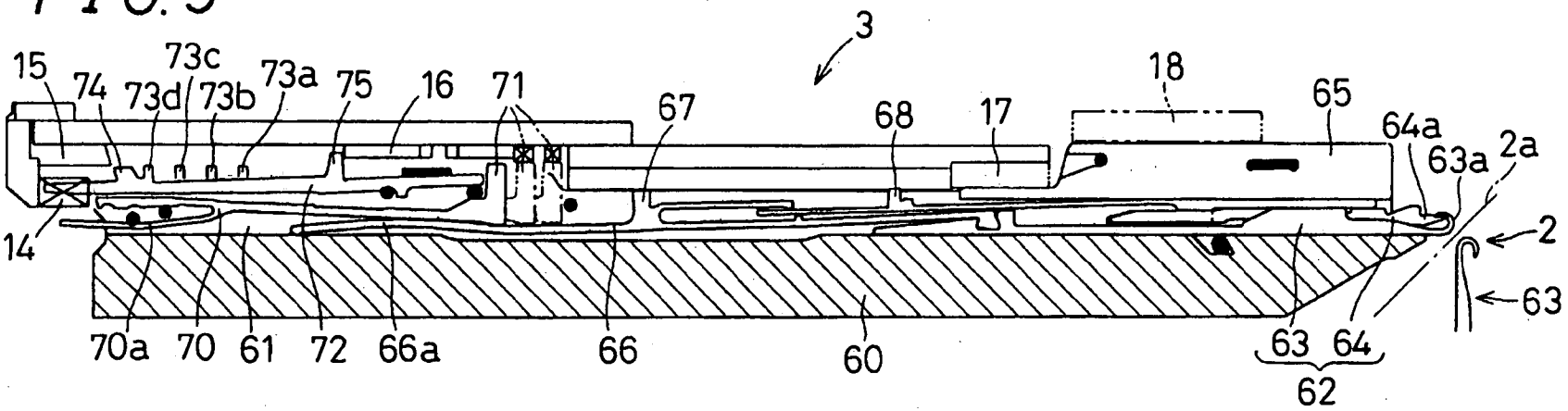
FIG. 3 is a section view showing a non-needle selection state where a select jack 70 is sank into a needle groove 61 at a position B in FIG. 1.
Figure 4:
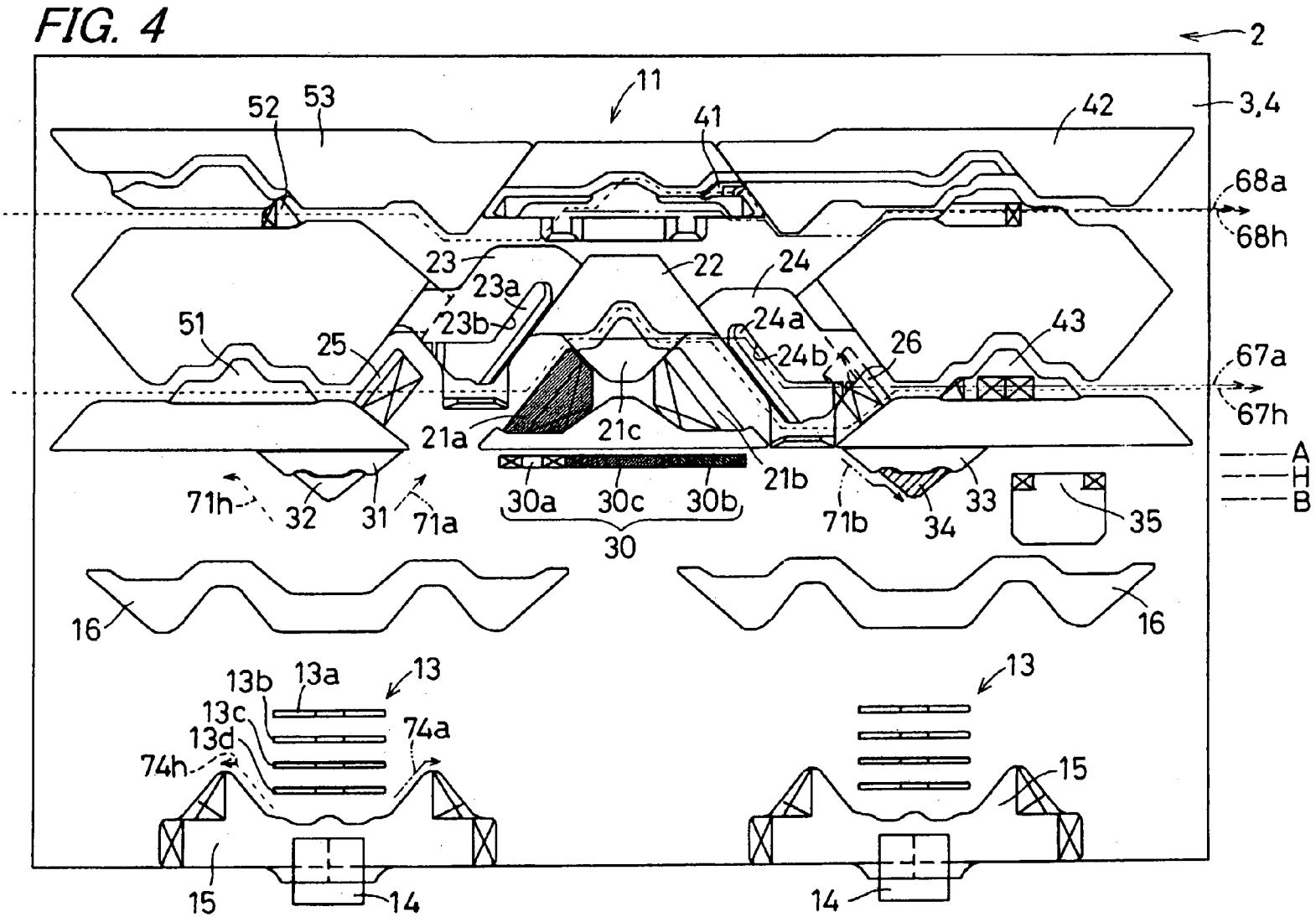
FIG. 4 is a cam layout showing a control state for knitting a fabric by each of the carriages 3 and 4 in FIG. 1.

FIGS. 2 and 3 show sectional constitutions of one needle bed 60, for example, the front needle bed. The rear needle bed has the basically same constitution. On the needle bed 60 are formed needle grooves 61 at regular intervals so that knitting needles such as a compound needle 62 are contained inside the needle grooves 61. The compound needle 62 includes a needle body 63 and a slider 64. A leading tip of the needle body 63 on the needle bed 2-side is provided with a hook 63*a*. The slider 64 has a leading tip thereof on the needle bed gap 2-side formed into two separate elastic laminas nipping the needle body therewith as shown in FIG. 4 in Japanese Examined Patent Publication JP-B2 2917146 and the like. The elastic lamina part has steps, one of which on the leading tip side is lower with a leading tip part thereof formed to be a tongue 64*a*. The needle body 62 and the slider 63 are pressed by a spacer 65 or the like so as not to move upward away from the needle groove 61 at the time of sliding displacement upward to or downward from the needle bed gap 2.

Inside the needle groove 61, the needle body 63 is coupled to a needle jack 66 at a tail tip side of the needle body 63 and a leading tip side of the needle jack 66. The needle jack 66 has an elastic portion 66*a* formed at a tail tip side thereof so that the elastic portion 66*a* biases the needle jack 66 in a direction of moving the needle jack 66 upward from a bottom of the needle groove 61. From the needle jack 66, a needle jack butt 67 protrudes toward outside of the needle groove 61. The needle jack butt 67 is subjected to an action of a needle body cam 10, and drives the needle body 62 to be displaced to an advanced or retracted position with respect to the needle bed gap 2 in the needle groove 61. Also from the slider 64, a slider butt 68 protrudes toward outside of the needle groove 61. When the needle jack 66 moves inside the needle groove 61 toward the needle bed gap 2, abutment of the leading tip of the needle jack 66 onto the slider butt 68 makes it possible to push up the slider 64 together with the needle body 63 toward the needle bed gap 2. When the slider butt 68 is made to be subjected to actions of the slider cam 11 shown in FIG. 1, and the slider raising cam 41, the slider transfer cam 42, the receiving-side retention raising cam 52, the receiving slider cam 53, and the like, it is possible to advance only the slider 64 further toward the needle bed gap 2.

The elastic portion 66*a* of the needle jack 66 can be pressed by a select jack 70. The select jack 70 has a tail tip side thereof formed to be an elastic portion 70*a* which abuts on the bottom of the needle groove 61. From a leading tip side, a select jack butt 71 protrudes outward from the needle groove 61. The select jack butt 71 is subjected to actions of the movable presser 30 in FIG. 1, the select jack half stitch cams 31 and 32, the select jack stitch cams 33 and 34, the select jack presser 35, and the like.

The select jack 70 is pressed inside the needle groove 61 by a selector 72. The selector 72 makes needle selection butts 73*a*, 73*b*, 73*c*, and 73*d* protrude outward from the needle groove 61, which needle selection butts 73*a*, 73*b*, 73*c*, and 73*d* are used for needle selection through the needle selection actuator 13 in FIG. 1. The selector float-up cam 14 pushes up the selector 72 from a bottom side thereof outward from the needle groove 61 so that the needle selection butts 71*a*, 73*b*, 73*c*, and 73*d* come into contact with the needle selection actuator 13 in FIG. 1. The needle selection butts 71*a*, 73*b*, 73*c*, and 73*d* are disposed at a plural, for example, four different positions, and four adjacent selectors 72 are provided respectively with different needle selection butts 71*a*, 73*b*, 73*c*, and 73*d*. At a tail end of the selector 72 is provided a push-up butt 74 which is subjected to an action of the selector push-up cam 15. From a leading tip side of the selector 72, a push-down butt 75 protrudes outward from the needle groove 61. The push-down butt 75 is subjected to an action of the selector guide cam 16 in FIG. 1.

FIG. 2 shows a needle selection state where the select jack 70 is pushed up to a position A in FIG. 1. FIG. 3 shows a non-needle selection state where the select jack 70 is sank into the needle groove 61 at a position B in FIG. 1. When sinking the select jack 70, the select jack 70 is sank inside the needle groove 61 and further, the needle jack 66 is also sank so that the needle jack butt 67 is no longer subjected to the action of the needle body cam 10. The select jack 70 may be positioned at a position H between the position A and the position B. At the position A, when the select jack butt 71 is sank into the needle groove 61 as a result of the action of the movable presser 30, the needle jack 66 is also sank into the needle groove 61 in conjunction therewith.

The non-needle selection state shown in FIG. 3 is a state where the needle selection butts 73*a*, 73*b*, 73*c*, and 73*d* are sank by the needle selection actuator 13, and the selector 72 is formed so as to have a larger sliding resistance to the needle groove 61 so that the state where the selector 72, the select jack 70, and the needle jack 66 are sank into the needle groove 61 can be kept until next float-up caused by the selector float-up cam 14. In the non-needle selection state where the needle selection butts 73*a*, 73*b*, 73*c*, and 73*d* of the selector 72 are not sank by the needle selection actuator 13, as shown in FIG. 2, the selector 72 has the push-up butt 74 pushed up by the selector push-up cam 15 so as to rise up inside the needle groove 61 toward the needle bed gap 2-side.

FIG. 4 shows a control state for knitting a fabric by each of the carriages 3 and 4. A portion in a protruding state of the inwardly-and-outwardly-displaceable control cam is shaded. The raising cam 21 includes controllable inward-and-outward portions 21*a* and 21*b* which are displaced to be in and out with respect to the bottom boards of the carriages 3 and 4, and a center cam 21*c*. The stitch cams 23 and 24 have recesses 23*a* and 24*a* and different-stitch-density cam faces 23*b* and 24*b* farther away in outward directions than lowering cam faces for formation of stitch density, in the moving directions of the carriages 3 and 4. The movable presser 30 is divided into right and left different-stitch-density tuck pressers 30*a* and 30*b* and a center tuck presser 30*c* which can be controlled to be separately displaced to be in and out from the bottom board. The needle selection actuator 13 has action pieces 13*a*, 13*b*, 13*c*, and 13*d* which respectively press the needle selection butts 73*a*, 73*b*, 73*c*, and 73*d* shown in FIGS. 2 and 3.

Assuming a case where the carriages 3 and 4 move leftward, the push-down butt 75 of the selector 72 coming closer from a left-hand side in FIG. 4 is pushed down at a left side of the selector guide cam 16 and until the needle selection butts 73*a*, 73*b*, 73*c*, and 73*d* reach positions of the action pieces 13*a*, 13*b*, 13*c*, and 13*d*, the selector 72 lowers. When a needle selection has been conducted by the needle selection actuator 13, the push-up butt 74 rises along a rising cam face of the selector push-up cam 15 as shown as a path 74*a*. As a result of the rise of the selector 72, the select jack 70 also rises as shown as a path 71*a* of the select jack butt 71 and reaches a position A. When the needle selection is not conducted by the needle selection actuator 13, the push-up butt 74 is sank into the needle groove 61 and not subjected to an action of the rising cam face of the selector push-up cam 15 so that the select jack 70 remains at a position B. That is to say, by the needle selection mechanism 12, a to-be-selected selector 72 is made to rise, by two steps, step after step among the position B, position H, and position A which are three control positions of the select jack 70.

In order to raise the select jack 70 to the position A and the position H, previously at end of a rightward movement before the leftward movement, a needle selection is conducted by the needle selection actuator 13 and the push-up butt 74 of the selector 72 is pushed up by the selector push-up cam 15 as shown by a path 74*h*. The select jack butt 71 is also pushed up as shown by a path 71*h*. Even at a position higher than the position H, at next leftward movement, the select jack butt 71 abuts on a left lowering cam face of a select jack half stitch cam 31 and is pushed down to the position H. Subsequently, the selector 72 is selected for needles by the needle selection actuator 13, and the selector 72 is pushed up by the selector push-up cam 15 and then, the select jack 70 can be pushed up to the position H or the position B, or further the position A. The select jack 70 can be thus located at the three position B, H, and A.

When the select jack 70 is located at the position H, the raising cam 21 makes the inward and outward portion 21*a* on the left side protrude, thereby making it possible to drive the knitting needle to perform a knitting operation for a knit. In the knitting operation for a knit, the needle jack 67 and the slider butt 68 respectively pass through paths 67*h* and 68*h* shown in dashed lines. When the select jack 70 is located at the position A, the select jack butt 71 can be made to act on the movable presser 30. This is because the needle jack butt 67 is no longer subjected to actions of the raising cam 21 and the cam faces of the stitch cams 23 and 24 when the select jack butt 71 is sank into the needle groove 61 by the movable presser 30.

When a different-stitch-density tuck presser 30*b* and a tuck presser 30*c* of the movable presser 30 are made to protrude, the needle jack 67 and the slider butt 68 are made to respectively pass through paths 67*a* and 68*a* shown in two-dot chain lines so that a knitting operation for a tuck of different stitch density can be carried out. Note that, when neither of the different-stitch-density tuck presser 30*a* and 30*b* and the tuck presser 30*c* is made to protrude, it is possible to perform the knitting operation for a knit even at the position A by making the inward-and-outward portion 21*a* of the raising cam 21 protrude. When a select jack stitch cam 34 is made to protrude, it is possible to make the select jack 50 lower to the position B as shown as a path 71*b* of the select jack butt 71. It is a matter of course that the position B indicates a position for a miss at which position the needle body 62 does not rise to the needle gap 2.

Figure 5:
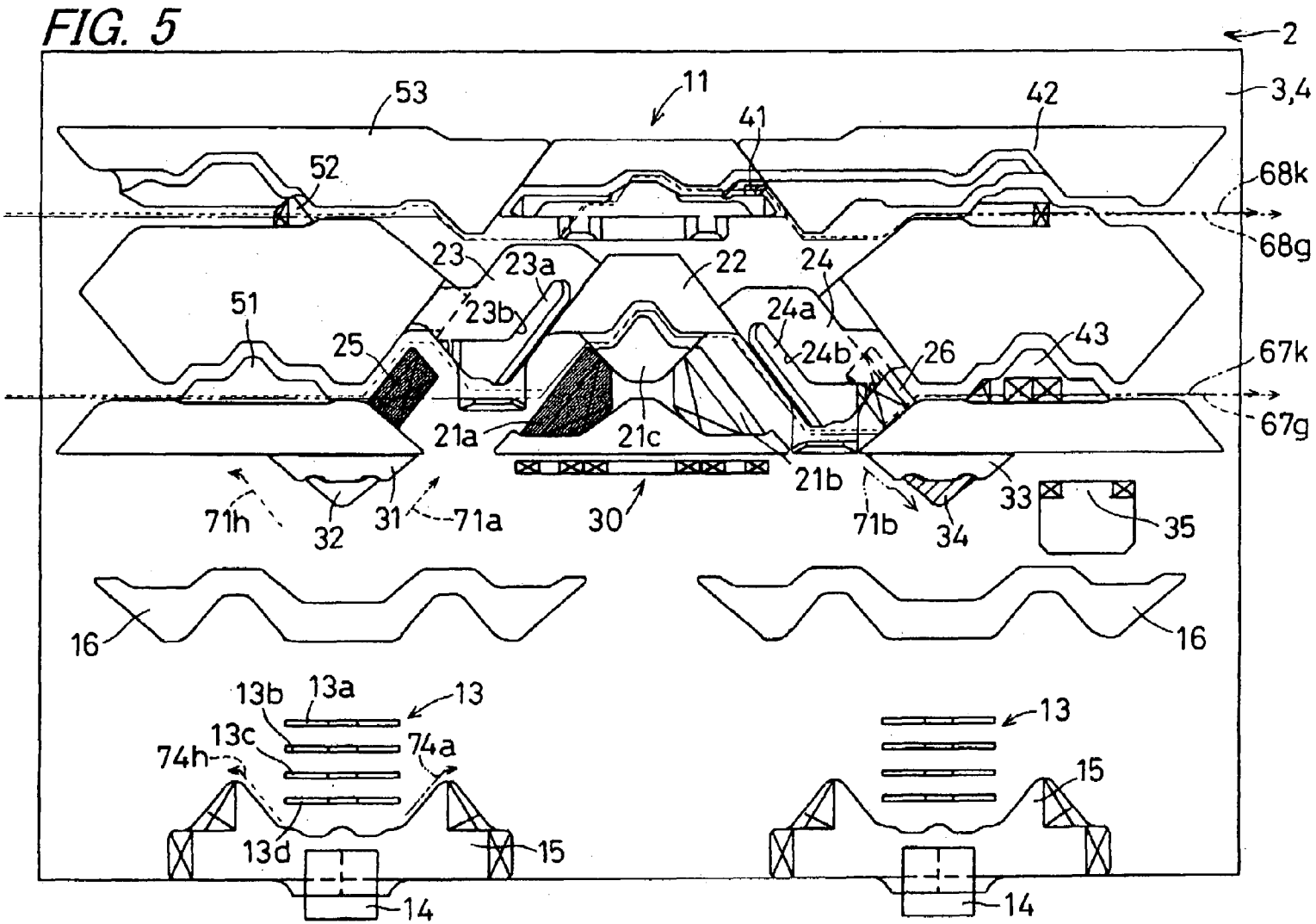
FIG. 5 is a cam layout showing a control state of performing an inlay stitch in a leftward movement of each of the carriages 3 and 4 in FIG. 1 by use of a rubber cam 25.

FIG. 5 shows a control state of performing an inlay stitch in leftward movements of the carriages 3 and 4 by use of a rubber cam 25. In a rightward movement before this leftward movement, knitting needles for tuck of stretch yarns such as rubber yarns are selected by the needle selection actuator 13, and the push-up butt 74 of the selector 72 is pushed up as shown by the path 74*h*, and the select jack butt 71 of the select jack 70 is pushed up as shown by the path 71*h*. In the next leftward movement, the needle jack butt 67 passes through a position of the receiving-side knitted loop receiving cam 51 since the select jack 70 is in a state of rising to the position H. The receiving-side knitted loop receiving cam 51, because of being in a sank state, passes and reaches a rising cam face of the rubber cam 25. As shown by a path 67*g* in a dashed line, the needle jack butt 67 rises up to a tuck position at the rubber cam 25 in a protruding state, and takes at the needle bed gap 2 the stretch yarn supplied from a yarn feeding port for inlay which comes before a yarn feeding port for supplying a knitting yarn for knitting. Furthermore, this knitting needle is selected by the needle selection actuator 13, and as shown by the path 74*a* and the path 71*a*, performs the knitting operation for a knit together with the knitting needle of which the select jack 70 is pushed up to the position A, by the raising cam 21, the guide cam 22, the stitch cam 24, and the slider cam 11, and further takes a knitting yarn supplied at the needle bed portion 2.

Figure 6:
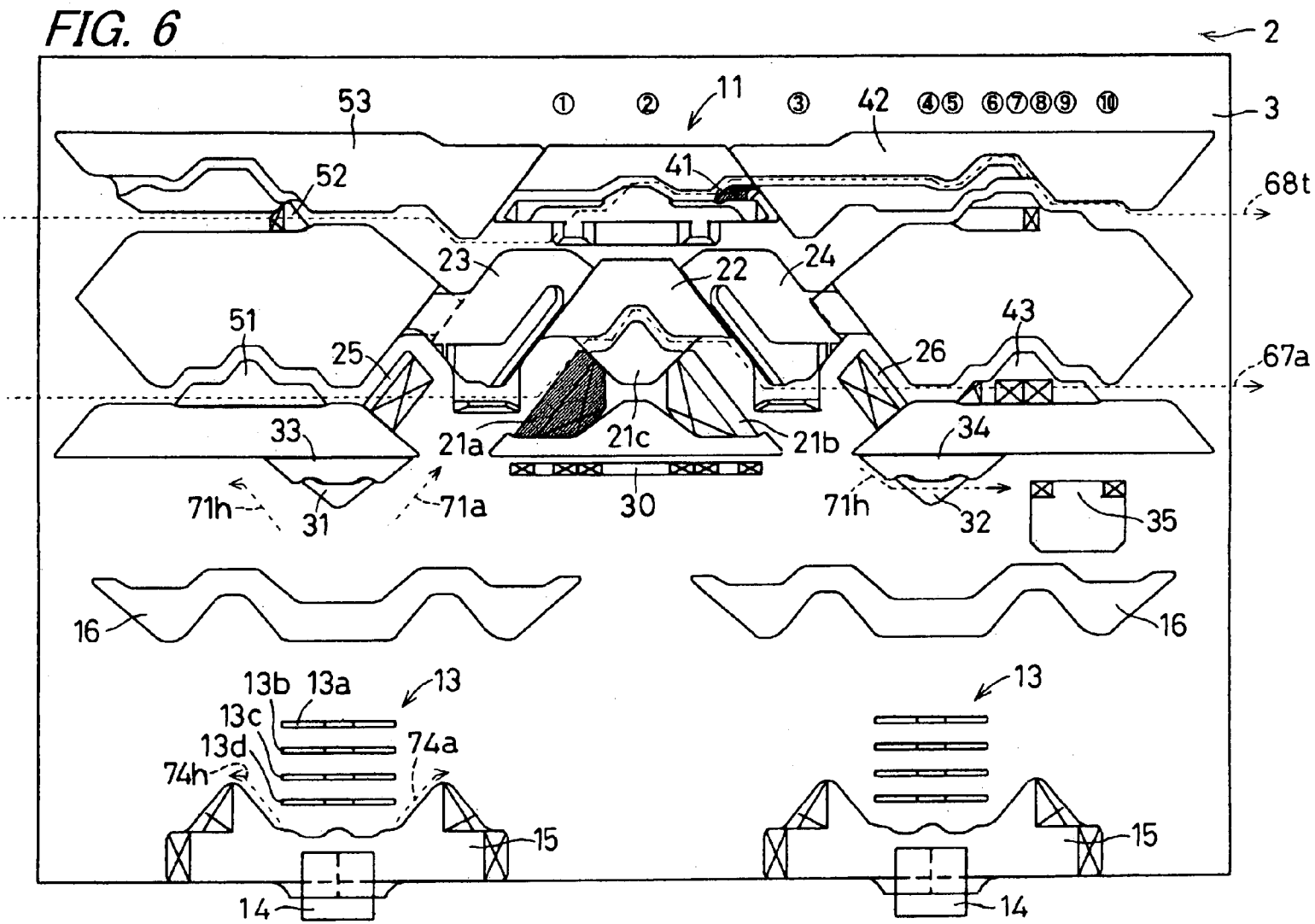
FIG. 6 is a cam layout showing a control state for transferring, having the carriage 3 in FIG. 1 facing the carriage in FIG. 7.
Figure 7:
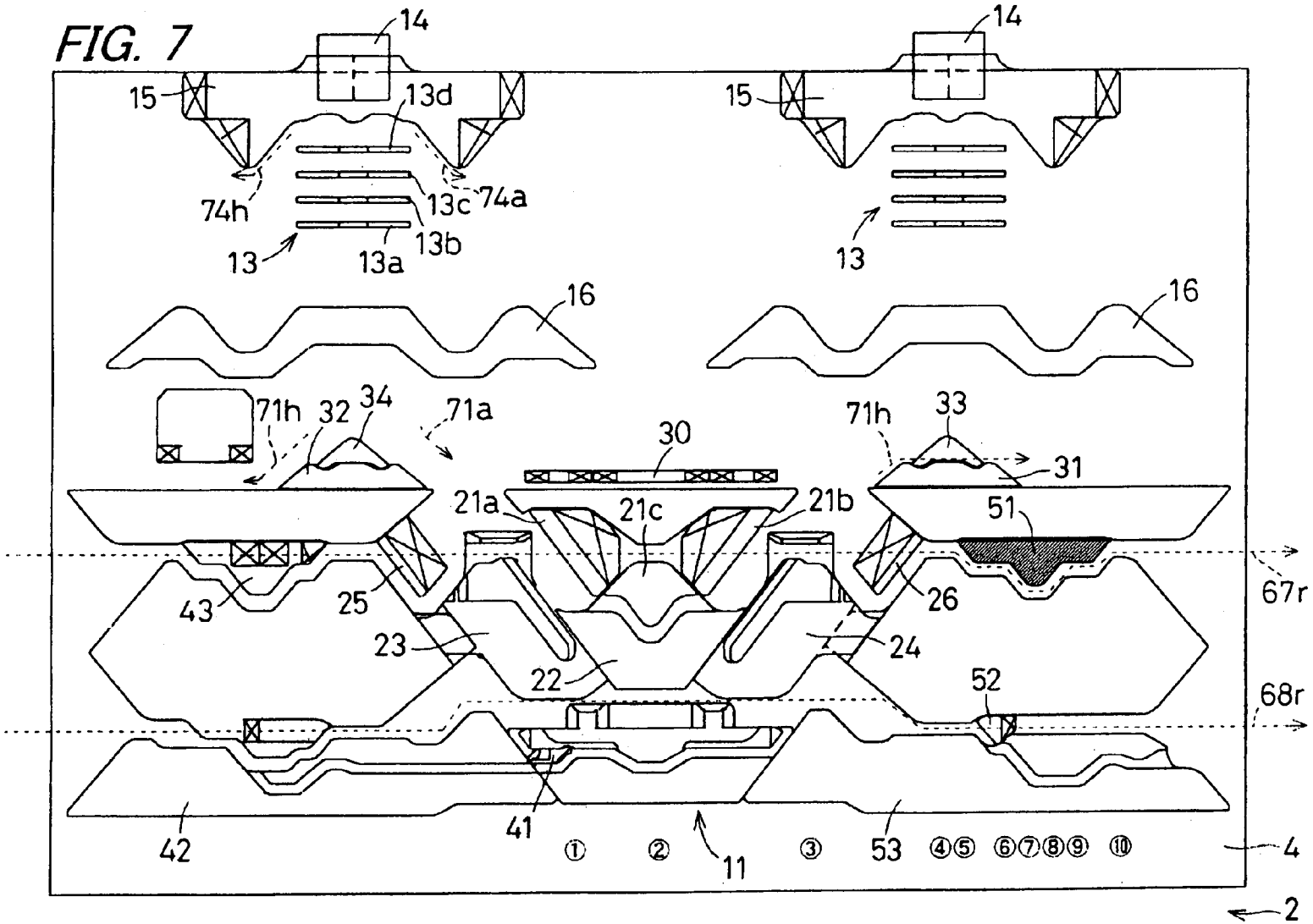
FIG. 7 is a cam layout showing a control state for receiving a knitted loop, having the carriage 4 in FIG. 1 facing the carriage in FIG. 6.
Figure 8:
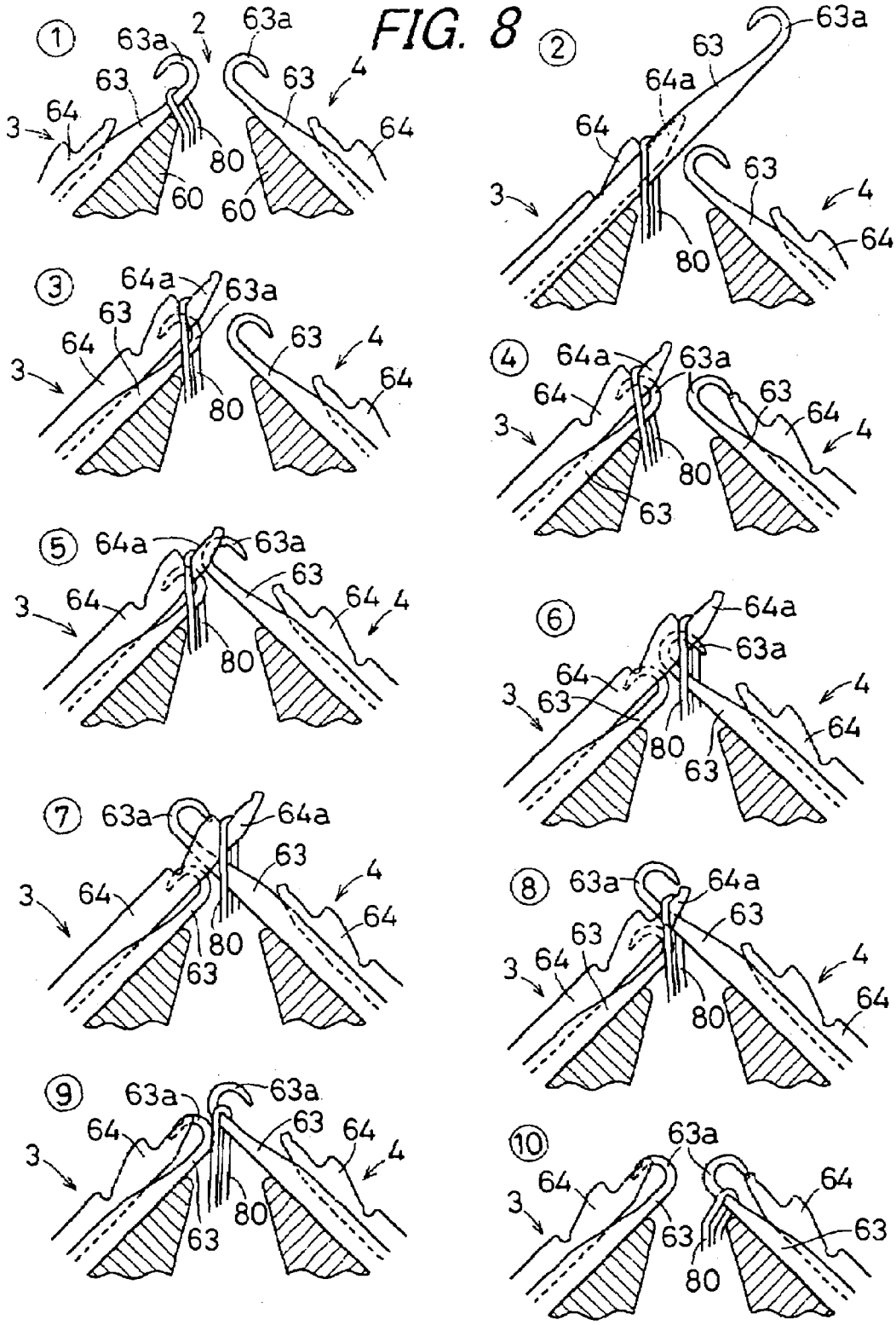
FIG. 8 is a partial section view showing a transferring process of the knitted loop in FIG. 6 and FIG. 7.

FIGS. 6 and 7 show control states at the time of transferring between the front and rear needle beds. FIG. 6 shows a transfer side while FIG. 7 shows a receiving side. FIG. 8 shows a transferring process at the needle bed gap 2. In a case where a knitted loop knitted at the front needle bed is transferred to the rear needle bed in the leftward movement of the carriages 3 and 4, the needle selection actuator 13 on a left side conducts a needle selection to the position H or the position A. From the carriage 3 on the transfer side, the inward-and-outward portion 21*a* of the raising cam 21 is made to protrude so that the knitting operation is carried out. Furthermore, the slider transfer raising cam 41 is made to protrude. The slider butt 68 of the slider 64 is guided to the cam route of the slider transfer cam 42 and as shown by a path 68*t*, passes through a transfer position for advancement toward the needle bed gap 2 which advancement is farther than the slider cam 11. From the carriage 4 on the receiving side, the inward-and-outward portions 21*a* and 21*b* of the raising cam 21 are not made to protrude, but the receiving-side knitted loop receiving cam 51 is made to protrude. The needle jack butt 67 of the needle jack 66 passes through a receiving position for advancement toward the needle bed gap 2, by the receiving-side knitted loop receiving cam 51 as shown by a path 67*r*.

A circulated number 1 shows a state immediately before the knitting needle having the needle jack butt 67 abutting on a rising cam face of the raising cam 21, starts to advance toward the needle bed gap 2. The slider 64 has lowered while the hook 63*a* is open. It is assumed that on the needle body 63-side driven by the carriage 3 on the needle bed at a front side is formed a knitted loop 80 which has been knitted in the previous course. A circulated number 2 shows a state where the needle body 63 advances farthermost toward the needle bed gap 2 by the center cam 21*c* of the raising cam 21 on the carriage 3. The slider 64 also advances toward the needle bed gap 2, and the knitted loop 80 is transferred from the hook 63*a* of the needle body 63 to the tongue 64*a* of the slider 64. A circulated number 3 shows a state where the needle body 63 is made to lower to the lowermost point by the stitch cam 24. Since the slider 64 moves to the cam route of the slider transfer cam 42 by the slider transfer raising cam 41 and keeps the raised position, a top of the hook 63*a* of the needle body 64 lowers to a position lower than the knitted loop 80 remained on the tongue 64*a* of the slider 64.

During a process between circulated numbers 4 and 10, transferring is carried out. At the circulated number 4, the slider 64 rises by the carriage 4 on the receiving side, and closes the hook 63*a* of the needle body 63. At the circulated number 5, the needle body 63 on the receiving side rises by the receiving-side knitted loop receiving cam 51, and a leading tip of the hook 63*a* proceeds into a space between two elastic laminas of which the tongue 64*a* of the slider 64 on the transfer side is formed. At the circulated number 6, the slider 64 on the transfer side rises to the uppermost position in consequence of being guided to the uppermost raised position of the cam route formed on the slider transfer cam 42. At the circulated number 7, the needle body 63 on the receiving side rises to the uppermost position. At the circulated number 8, the slider 64 on the transfer side starts to lower and transfers the knitted loop 80 retained on the tongue 64*a* to the hook 63*a* of the needle body 63 on the receiving side. At the circulated number 9, the slider 64 on the transfer side lowers to a position lower than the knitted loop 80, and the knitted loop 80 is transferred to the hook 63*a* of the needle body 63 on the receiving side. The circulated number 10 shows a state where the needle body 63 on the receiving side also lowers and the hook 63*a* is closed by the slider 64.

Figure 9:
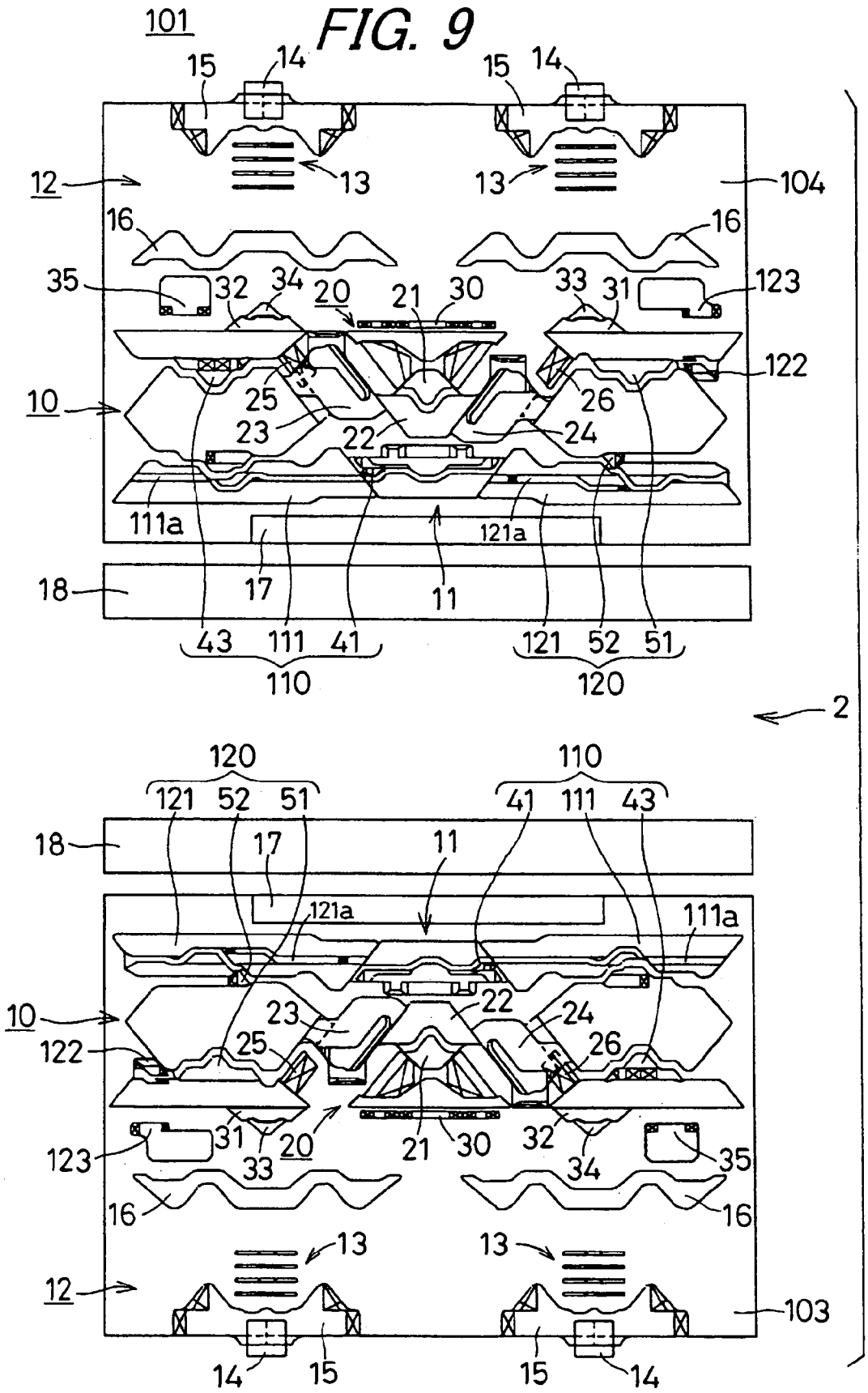
FIG. 9 is a schematic cam layout of a cam apparatus 101 for knitting a fabric according to another embodiment of the invention.

FIG. 9 shows a schematic cam layout of a cam apparatus 101 for knitting a fabric according to another embodiment of the invention. In this embodiment, components corresponding to those in the embodiment of FIG. 1 will be denoted by the same reference symbols and overlapping descriptions will be omitted. Also in this embodiment, each of carriages 103 and 104 provided on the front and rear needle beds is provided with a group of transfer cams 110 and a group of receiving cams 120. In the group of transfer cams 110, a slider transfer cam 111 is used instead of the slider transfer cam 42 of the group of transfer cams 40 in FIG. 1. In the group of receiving cams 120, a receiving slider cam 121 is used instead of the receiving slider cam 53 of the group of receiving cams 40 in FIG. 1. The slider transfer cam 111 and the receiving slider cam 121 are provided respectively with a cam route 111*a* and a groove 121*a* for keeping a state where the slider 64 advances to the needle bed gap 2 so that the knitted loop 80 is retained on the tongue 64*a*. In order to keep this retaining state, a needle jack guide cam 122 and a holding presser 123 are also provided. The grooves of the cam routes 111*a* and 121*a* engage with a few grooves for guidance even in a state where the slider butt 68 is sank into the needle groove 61. In this regard, the aforementioned grooves of the cam routes 111*a* and 121*a* are not always necessary.

As will be described hereinafter with regard to a continued holding, it is possible to keep the state where the tongue 64*a* of the slider is made to advance to the needle bed gap 2, by making the select jack butt 71 lower to the position B and making the needle jack butt 67 and the slider butt 68 sink into the needle groove 61. In this sate, the slider butt 68 may be used without replacing the slider transfer cam 42 and the receiving slider cam 53.

Figure 10:
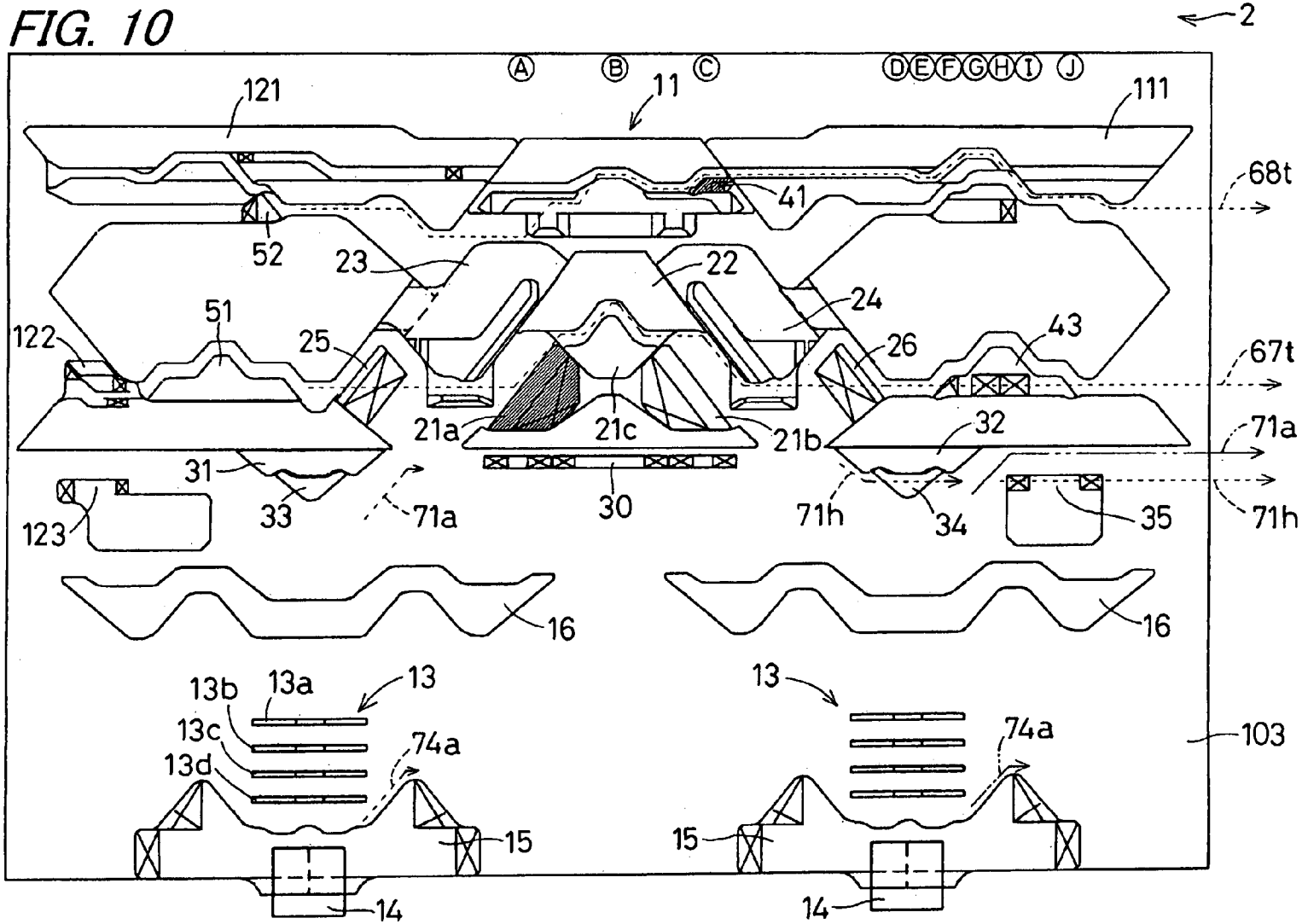
FIG. 10 is a cam layout showing a control state for transferring, having the carriage 103 in FIG. 9 facing the carriage in FIG. 11.
Figure 11:
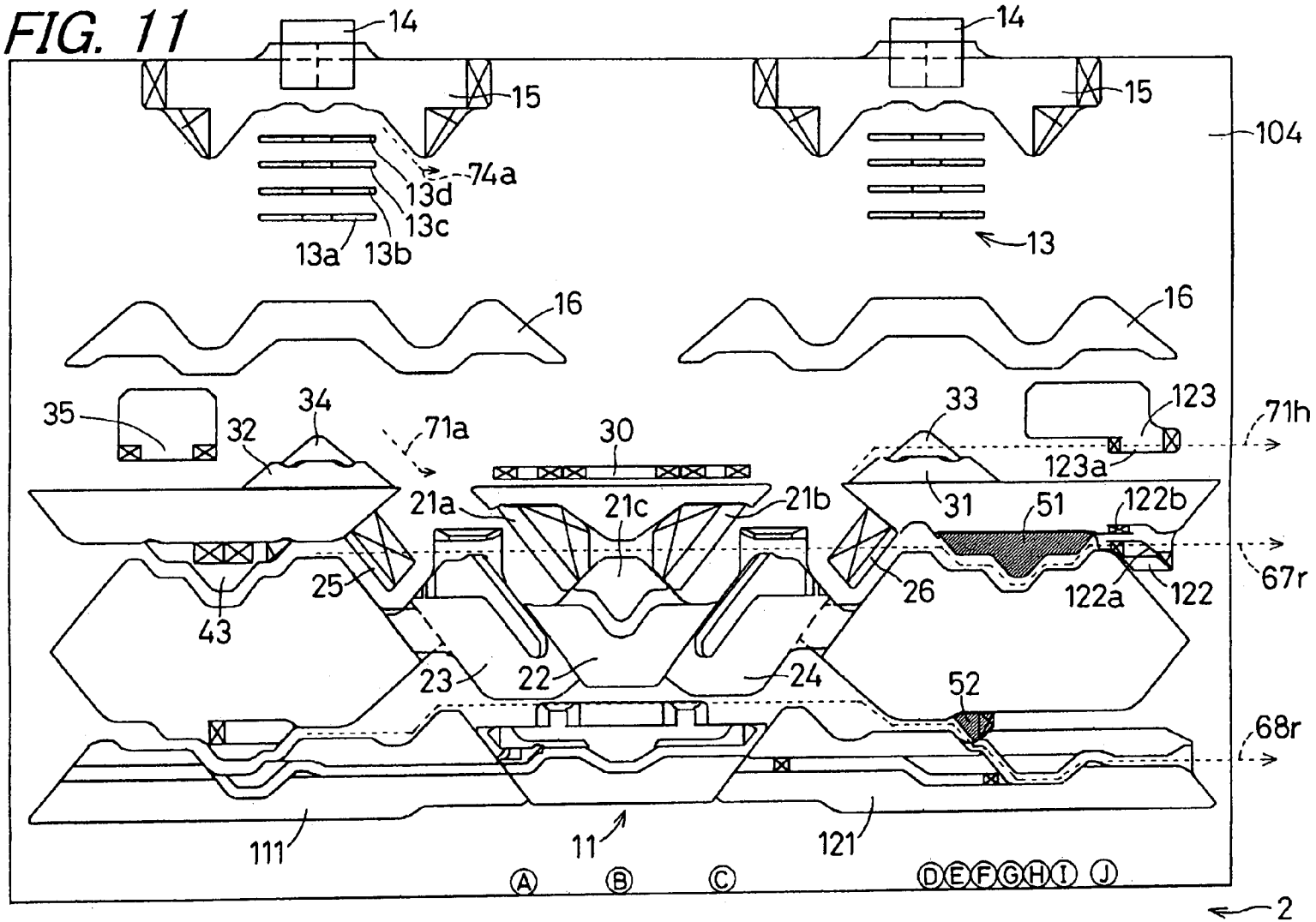
FIG. 11 is a cam layout showing a control state for receiving a knitted loop, having the carriage 104 in FIG. 9 facing the carriage in FIG. 10.
Figure 12:
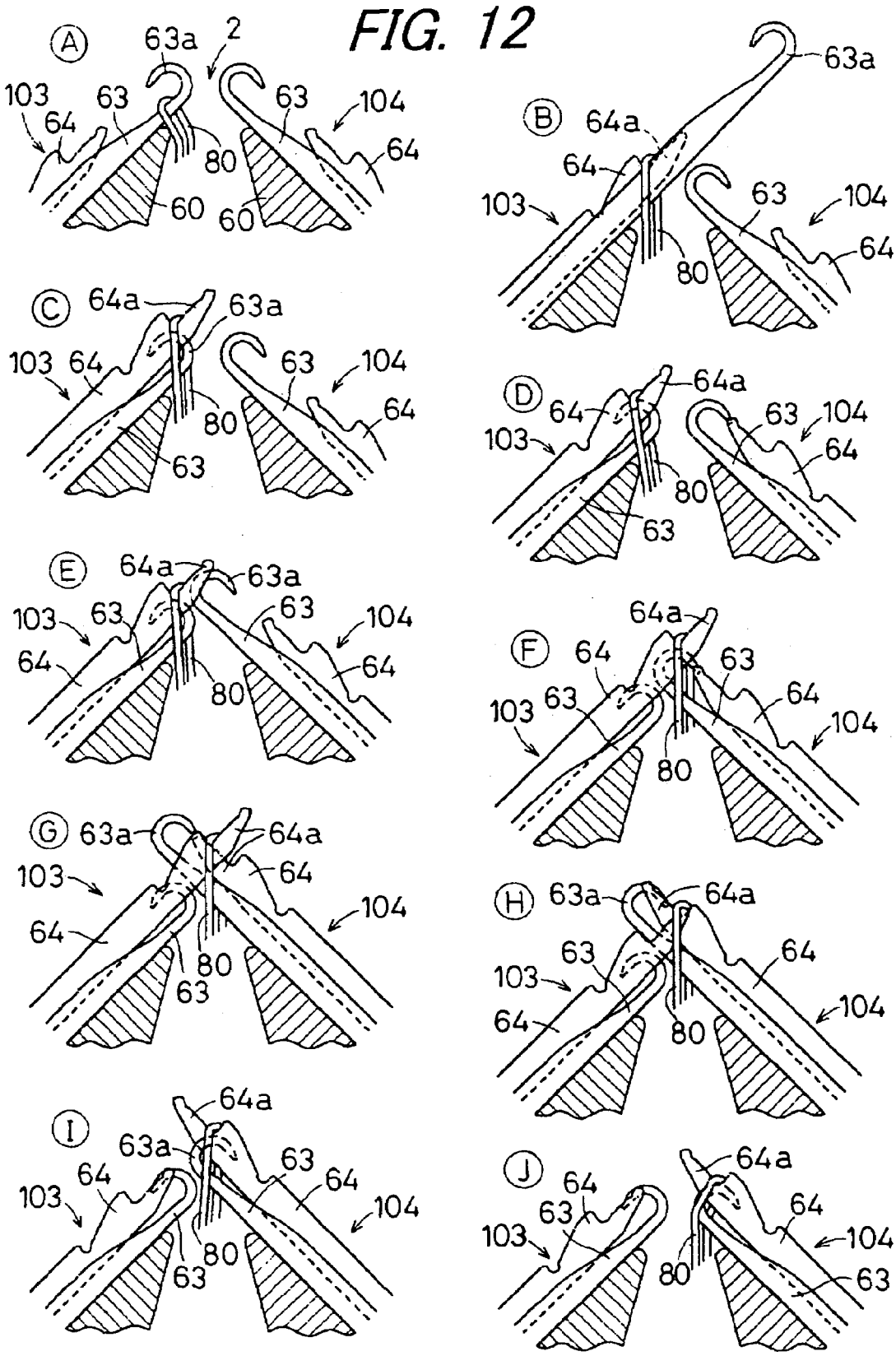
FIG. 12 is a partial section view showing a transferring process of the knitted loop in FIG. 10 and FIG. 11.

FIGS. 10 and 11 show control states at the time of transferring between the front and rear needle beds. FIG. 10 shows a transfer side while FIG. 11 shows a receiving side. In this regard, on the receiving side, the knitted loop 80 is taken on the tongue 64*a* of the slider 64. FIG. 12 shows a transferring process at the needle bed gap 2.

In a case where a knitted loop knitted at the front needle bed is transferred to the rear needle bed in the leftward movement of the carriages 103 and 104, the needle selection actuator 13 on a left side conducts a needle selection to the position A. From the carriage 103 on the transfer side, the inward-and-outward portion 21*a* of the raising cam 21 is made to protrude so that the knitting operation is carried out. Furthermore, the slider transfer raising cam 41 is made to protrude. The slider butt 68 of the slider 64 is guided to the cam route of the slider transfer cam 111 and as shown by a path 68*t*, passes through a transfer position for advancement toward the needle bed gap 2 which advancement is farther than the slider cam 11. At this time, the needle selection actuator 13 on a right side previously selects a needle for receiving in a next course, to the position A as shown by a path 74*a*. From the carriage 4 on the receiving side, the inward-and-outward portions 21*a* and 21*b* of the raising cam 21 are not made to protrude, but the receiving-side knitted loop receiving cam 51 is made to protrude. The needle jack butt 67 of the needle jack 66 passes through a receiving position for advancement toward the needle bed gap 2, by the receiving-side knitted loop receiving cam 51 as shown by a path 67*r*. Furthermore, the receiving-side retention raising cam 52 is made to protrude, and the slider butt 68 of the slider 64 is guided to a route for keeping a retaining state of the receiving slider cam 121 so that the retaining position can be kept as shown by a path 68*r*.

A circulated symbol A shows a state immediately before the knitting needle having the needle jack butt 67 abutting on a rising cam face of the raising cam 21, starts to advance toward the needle bed gap 2. The slider 64 has lowered while the hook 63*a* is open. It is assumed that on the needle body 63-side driven by the carriage 103 on the needle bed at a front side is formed a knitted loop 80 which has been knitted in the previous course. A circulated symbol B shows a state where the needle body 63 advances farthermost toward the needle bed gap 2 by the center cam 21*c* of the raising cam 21 on the carriage 103. The slider 64 also advances toward the needle bed gap 2, and the knitted loop 80 is transferred from the hook 63*a* of the needle body 63 to the tongue 64*a* of the slider 64. A circulated symbol C shows a state where the needle body 63 is made to lower to the lowermost point by the stitch cam 24. Since the slider 64 moves to the cam route of the slider transfer cam 111 by the slider transfer raising cam 41 and keeps the raised position, a top of the hook 63*a* of the needle body 64 lowers to a position lower than the knitted loop 80 remained on the tongue 64*a* of the slider 64.

During a process between circulated symbols D and J, transferring is carried out. At the circulated symbol D, the slider 64 rises by the carriage 104 on the receiving side, and closes the hook 63*a* of the needle body 63. At the circulated symbol E, the needle body 63 on the receiving side rises by the receiving-side knitted loop receiving cam 51, and a leading tip of the hook 63*a* proceeds into a space between two elastic laminas of which the tongue 64*a* of the slider 64 on the transfer side is formed. At the circulated symbol F, the slider butt 68 of the slider 64 on the transfer side is guided to the uppermost raised position of the cam route formed on the slider transfer cam 111 so that the slider 64 on the transfer side rises to the uppermost position. The slider butt 68 of the slider 64 on the receiving side is guided to the cam route of the receiving slider cam 121 by the receiving-side retention raising cam 52 so that the slider 62 on the receiving side starts to rise. Accordingly, the operations at the circulated symbols A to E in FIG. 12 are the same respectively to those at the circulated numbers 1 to 5 in FIG. 8 while the operations at the circulated symbol F and the following numbers are different from those at the circulated number 6 and the following numbers.

Note that the needle jack guide cam 122 is provided with a lowering face 122*a* and a pressing slope 122*b*. In a case where the carriage 104 moves in a rightward movement, the needle jack butt 67 is guided from the lowering face 121*a* to the pressing slope 121*b* on condition that the path of the select jack butt 71 does not pass through a pressing portion 123*a* of the holding presser 123.

At the circulated symbol G in FIG. 12, the slider 64 rises to the uppermost position together with the needle body 63 on the receiving side. At the circulated symbol H, the slider 64 on the transfer side starts to lower and transfers the knitted loop 80 retained on the tongue 64*a* to the tongue 64*a* of the slider 64 on the receiving side. At the circulated symbol I, the slider 64 on the transfer side lowers to a position lower than the knitted loop 80, and the needle body 63 on the receiving side also lowers, in consequence whereof the knitted loop 80 is transferred to the tongue 64*a* of the slider 64 on the receiving side. The circulated symbol J shows a state where the needle body 63 and slider 64 on the receiving side lower farther, and the hook 63*a* is closed by the slider 64. In the transferring process as described above, it is possible to receiving the knitted loop 80 while retaining another knitted loop on the hook 63*a* of the needle body 63 on the receiving side. That is to say, it is possible to deal with the operation in a state where the knitted loop 80 is temporarily placed on the slider 64 on the receiving side (this state is hereinafter referred to as "holding").

Figure 13:
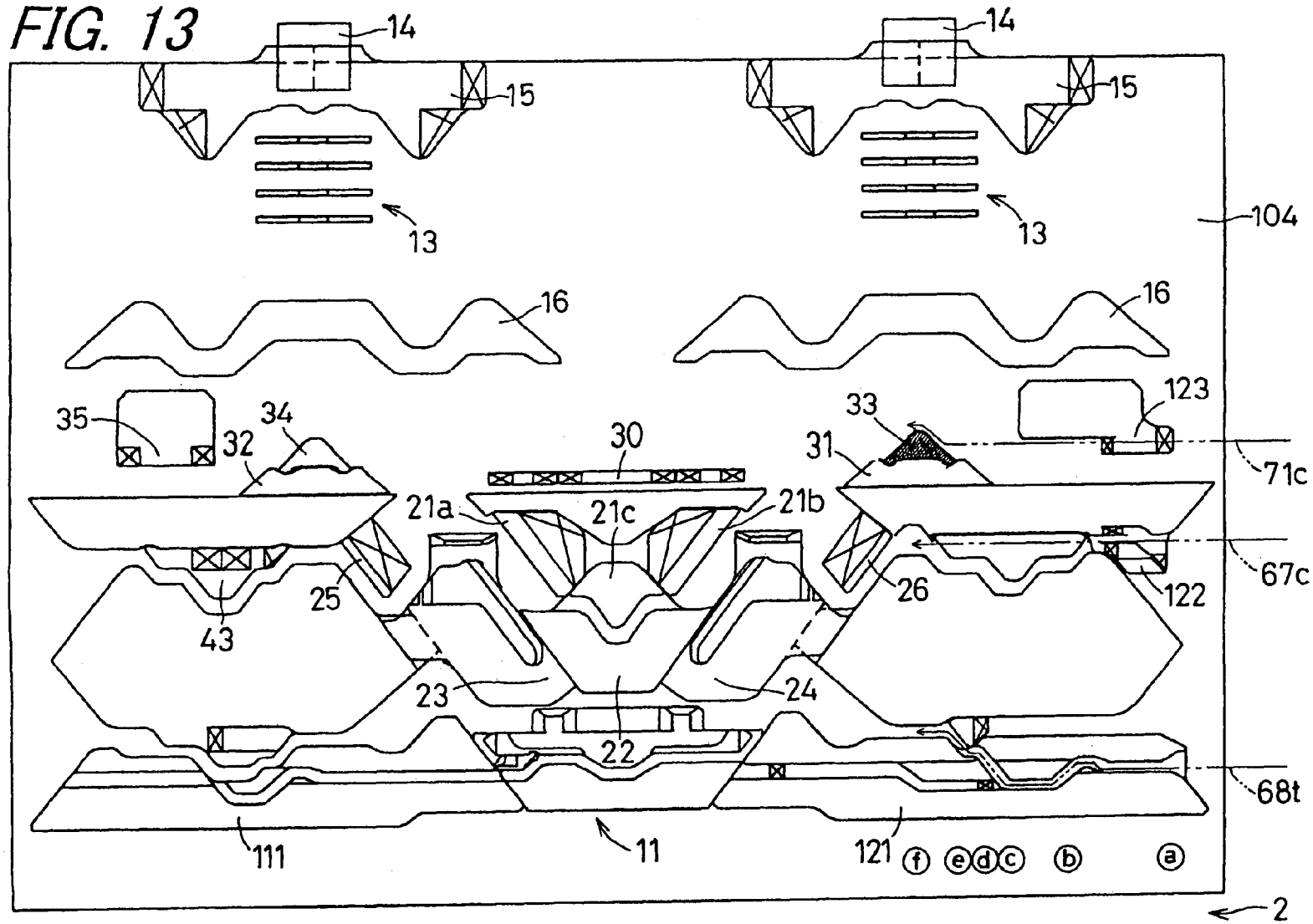
FIG. 13 is a cam layout showing a control state for transferring to return the knitted loop, having the carriage 104 in FIG. 9 facing the carriage in FIG. 14.
Figure 14:
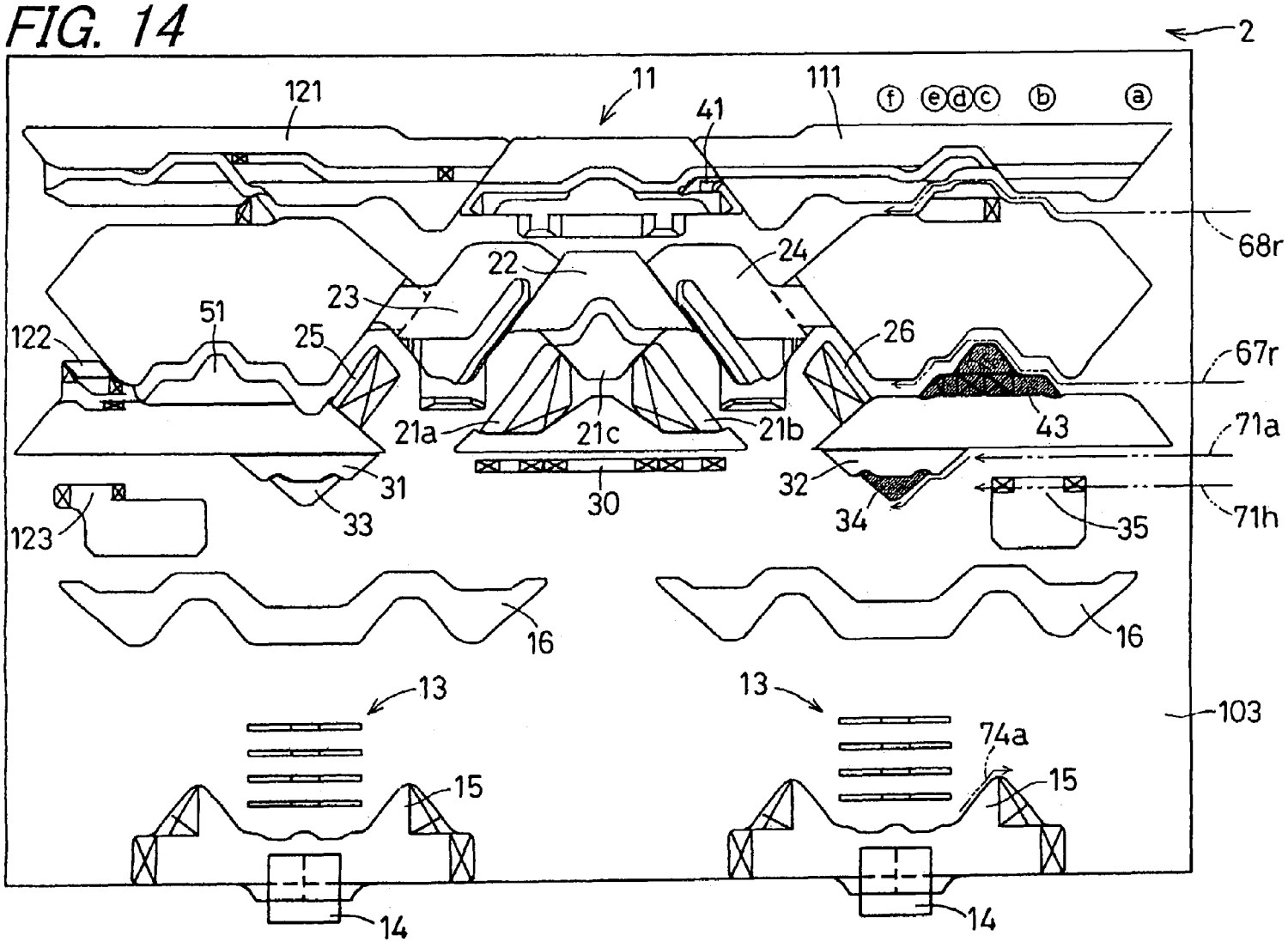
FIG. 14 is a cam layout showing a control state for receiving the to-be-returned knitted loop, having the carriage 103 in FIG. 9 facing the carriage in FIG. 13.
Figure 15:
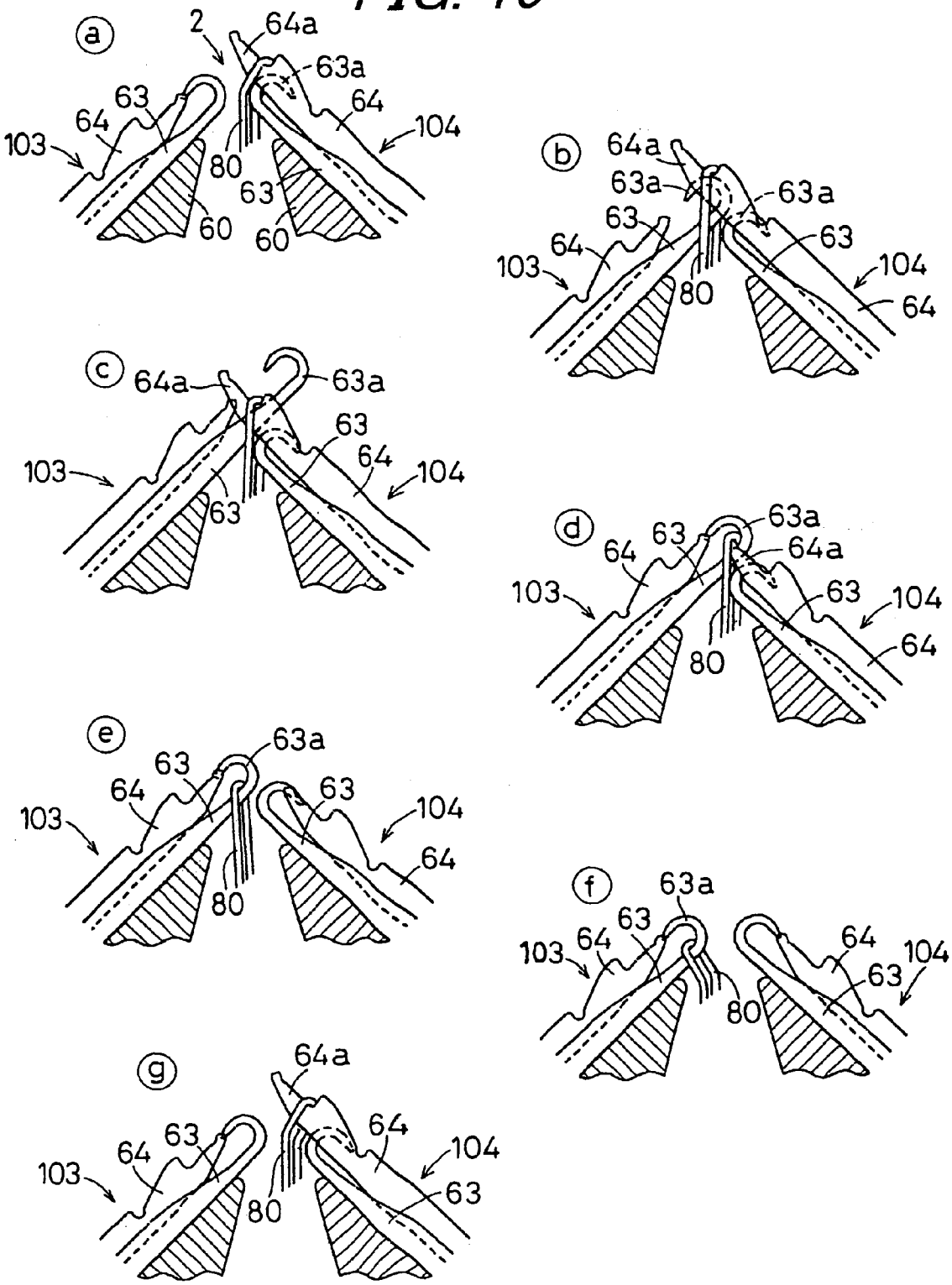
FIG. 15 is a partial section view showing a transferring process of the knitted loop in FIG. 13 and FIG. 14.

FIGS. 13 and 14 show states at the time of returning the knitted loop after transferring between the front and rear needle beds as shown in FIGS. 10 to 12. FIG. 13 shows a transfer side while FIG. 14 shows a receiving side. In this regard, the carriage 104 on the receiving side in FIG. 10 is now on the transfer side while the carriage 103 is now on the receiving side. A returning operation is carried out in the rightward movement of the carriages 103 and 104. FIG. 15 shows a returning process at the needle bed gap 2.

As shown in FIG. 13, from the carriage 104 on the transfer side, a select jack stitch cam 33 is made to protrude and as shown by a path 71*c* of the select jack butt 71 of the select jack 70, the selector 72 is made to lower to the position B. In the meantime, the slider butt 68 of the slider 64 passes through the cam route of the receiving slider cam 121 as shown by the path 68*t*, and rises up to the transfer position. The needle jack butt 67 of the needle jack 66 keeps a certain height thereof as shown by a path 67*c*.

As shown in FIG. 14, on the carriage 103 on the receiving side, the needle jack butt 67 of the needle jack 66 rises by the transferring knitted loop receiving cam 43 as shown by the path 67*r*, and the slider butt 68 of the slider 64 also rises as shown by the path 68*r*. The select jack butt 71 of the select jack 70 is pushed down by the select jack half stitch cam 32 and the select jack stitch cam 34 as shown by the paths 71*a* and 71*h*.

A circulated symbol a in FIG. 15 shows a state corresponding to a position where the slider butt 68 is guided in accordance with the path 68*t* to the cam route of the receiving slider cam 121 on the carriage 104. A circulated symbol b shows a state where the needle body 63 on the receiving side starts to rise by the transfer-side knitted loop receiving cam 43, and the leading tip of the hook 63*a* is inserted into the tongue 64*a* of the slider 64 on the transfer side. A circulated symbol c shows a state where the slider 64 on the transfer side and the needle body 63 on the receiving side respectively rise to the uppermost position. A circulated symbol d shows a state where the slider 64 on the transfer side and the needle body 63 on the receiving side respectively lower, and the knitted loop 80 is transferred to the hook 63*a* of the needle body 63 on the receiving side which hook 63*a* is closed by the slider 64. A circulated symbol e shows a state where the slider 64 on the transfer side lowers with the closed needle body 63 and moves away from the knitted loop 80. A circulated symbol f shows a state where the needle body 63 and the slider 64 on the receiving side lower to a miss position.

Figure 16:
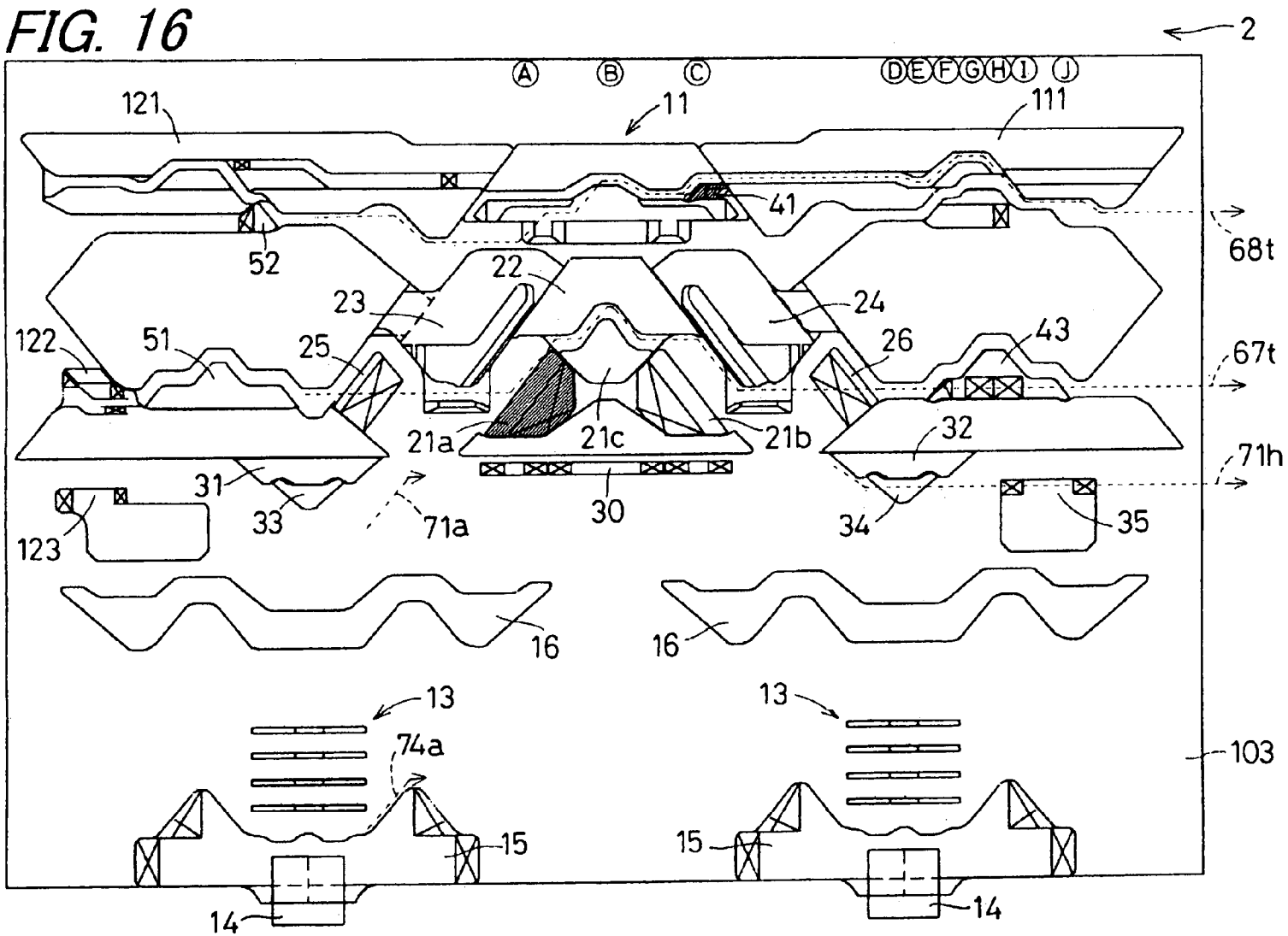
FIG. 16 is a cam layout showing a control state for transferring, having the carriage 103 in FIG. 9 facing the carriage in FIG. 17.
Figure 17:
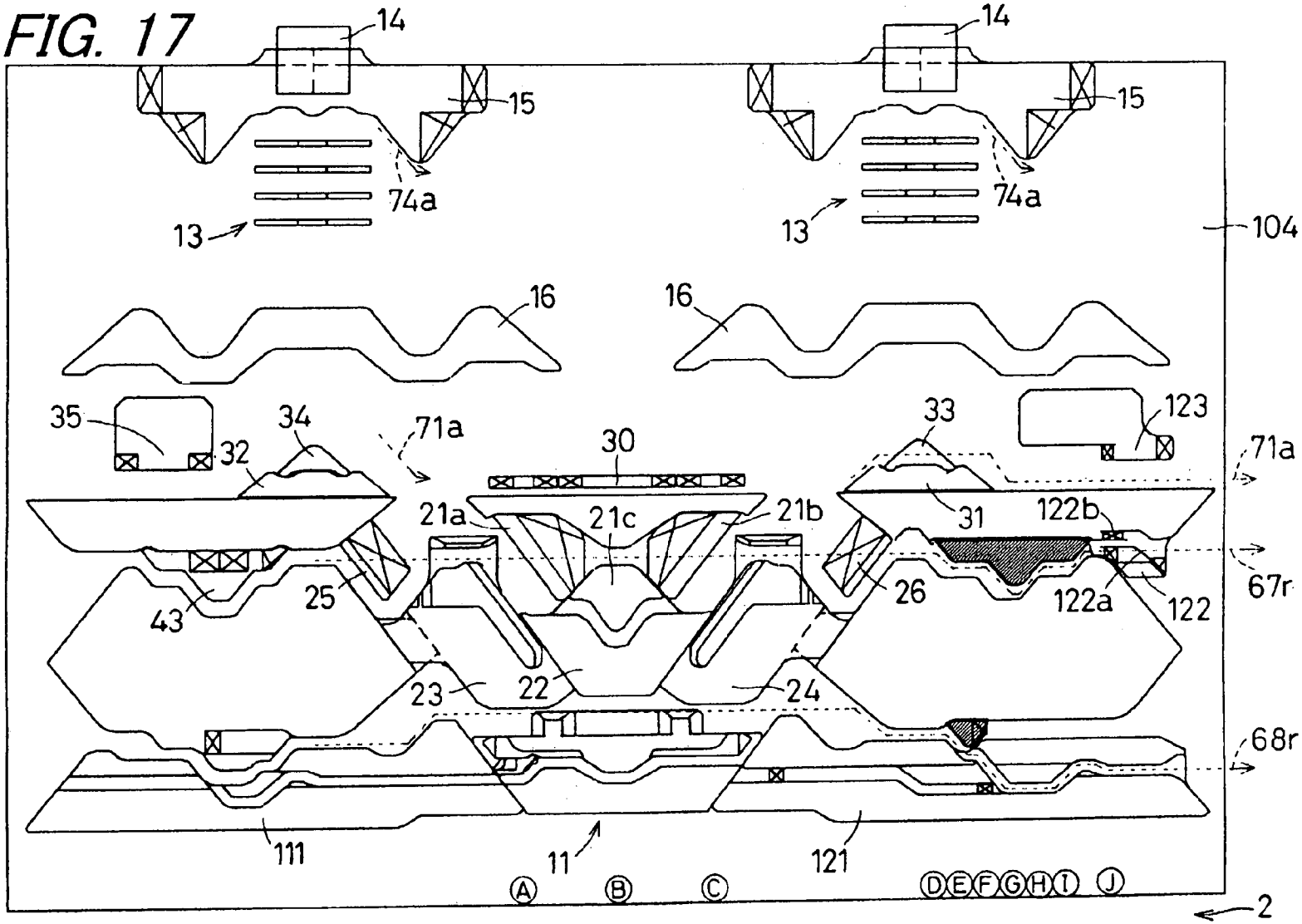
FIG. 17 is a cam layout showing a control state for receiving a knitted loop and keeping on holding, having the carriage 104 in FIG. 9 facing the carriage in FIG. 16.

FIGS. 16 and 17 show control states at the time of transferring between the front and rear needle beds similarly to FIGS. 10 and 11. FIG. 16 shows a transfer side while FIG. 17 shows a receiving side. In this regard, on the receiving side, the operation ends in a continuing state for keeping the holding state where the knitted loop 80 is taken and retained on the tongue 64*a* of the slider 64. Accordingly, on the carriage 104 on the receiving side, the selector 72 is selected by the following needle selection actuator 13 on the right side so that the selector push-up cam 15 pushes up the push-up butt 74 as shown by the path 74*a* and the select jack butt 71 of the select jack 70 has previously been made to rise up as shown by the path 71*a* to the position A where no abutment with the holding presser 123 is made.

Figure 18:
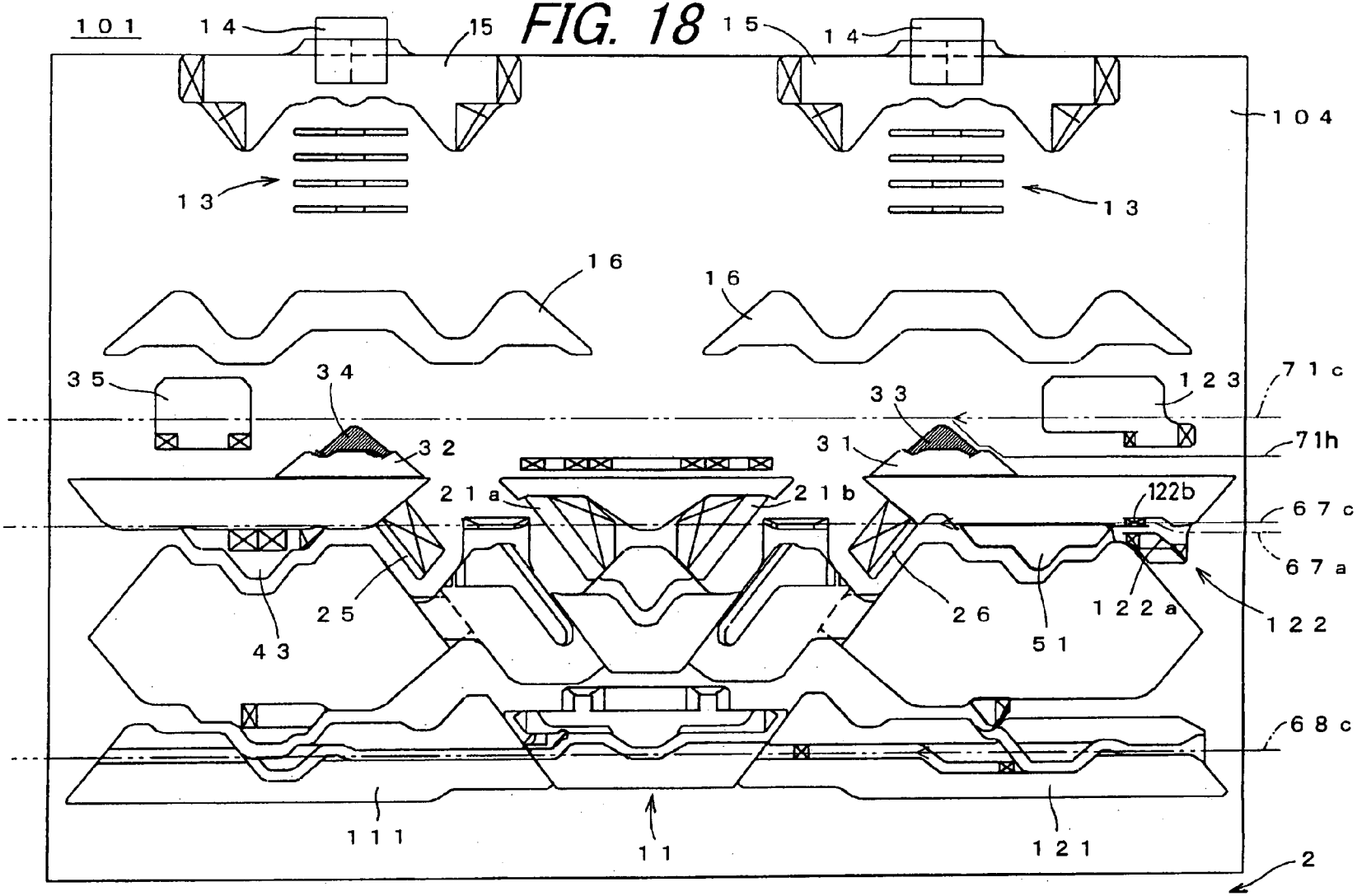
FIG. 18 is a cam layout showing a control state for keeping on holding after receiving the knitted loop, having the carriage 103 in FIG. 9 facing the carriage in FIG. 19.
Figure 19:
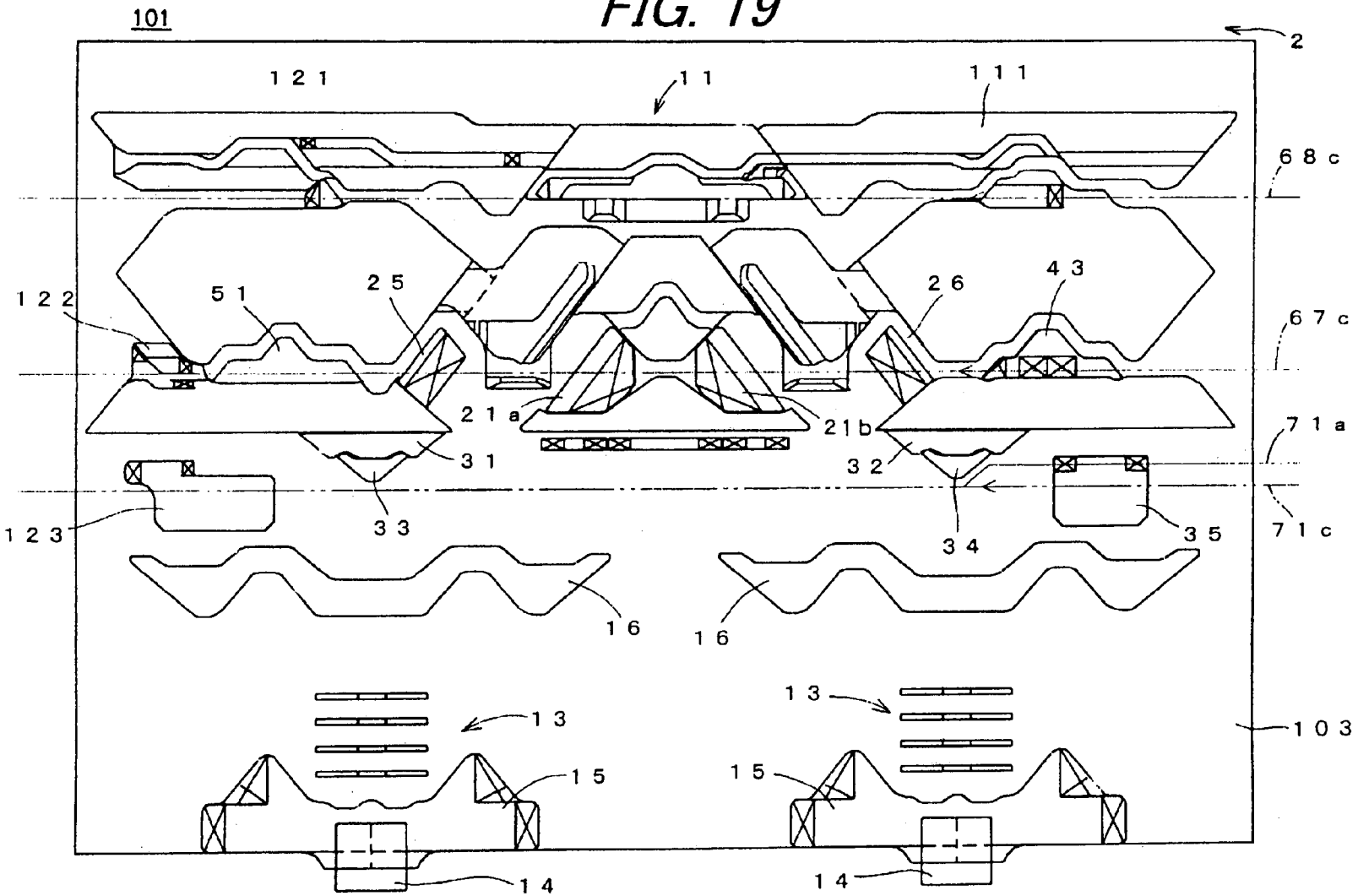
FIG. 19 is a cam layout showing a control state for keeping on holding, having the carriage 104 in FIG. 9 facing the carriage in FIG. 18.
Figure 20:
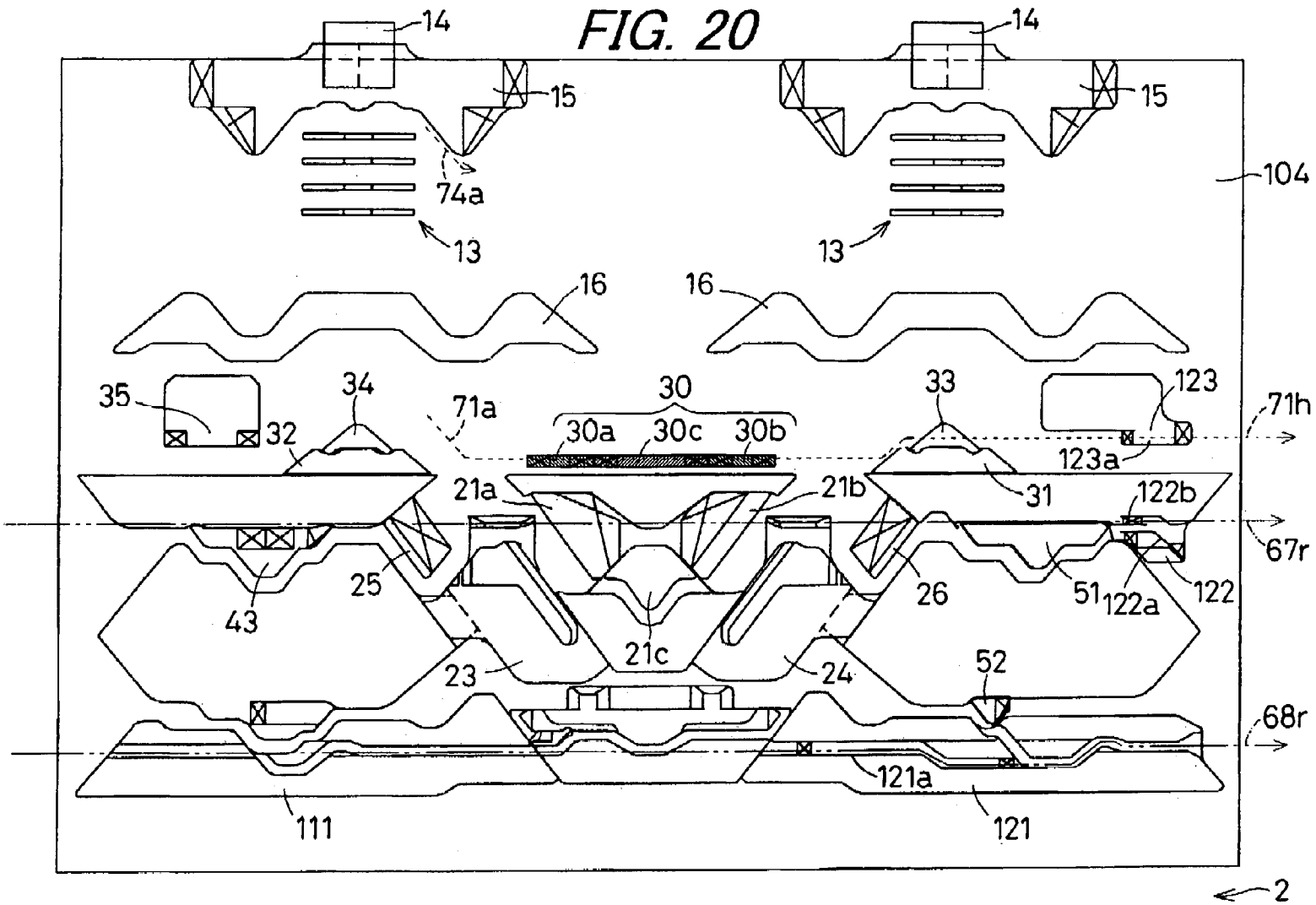
FIG. 20 is a cam layout showing a control state for preparing for return of the knitted loop after the continued holding, having the carriage 104 in FIG. 9 facing the carriage in FIG. 21.
Figure 21:
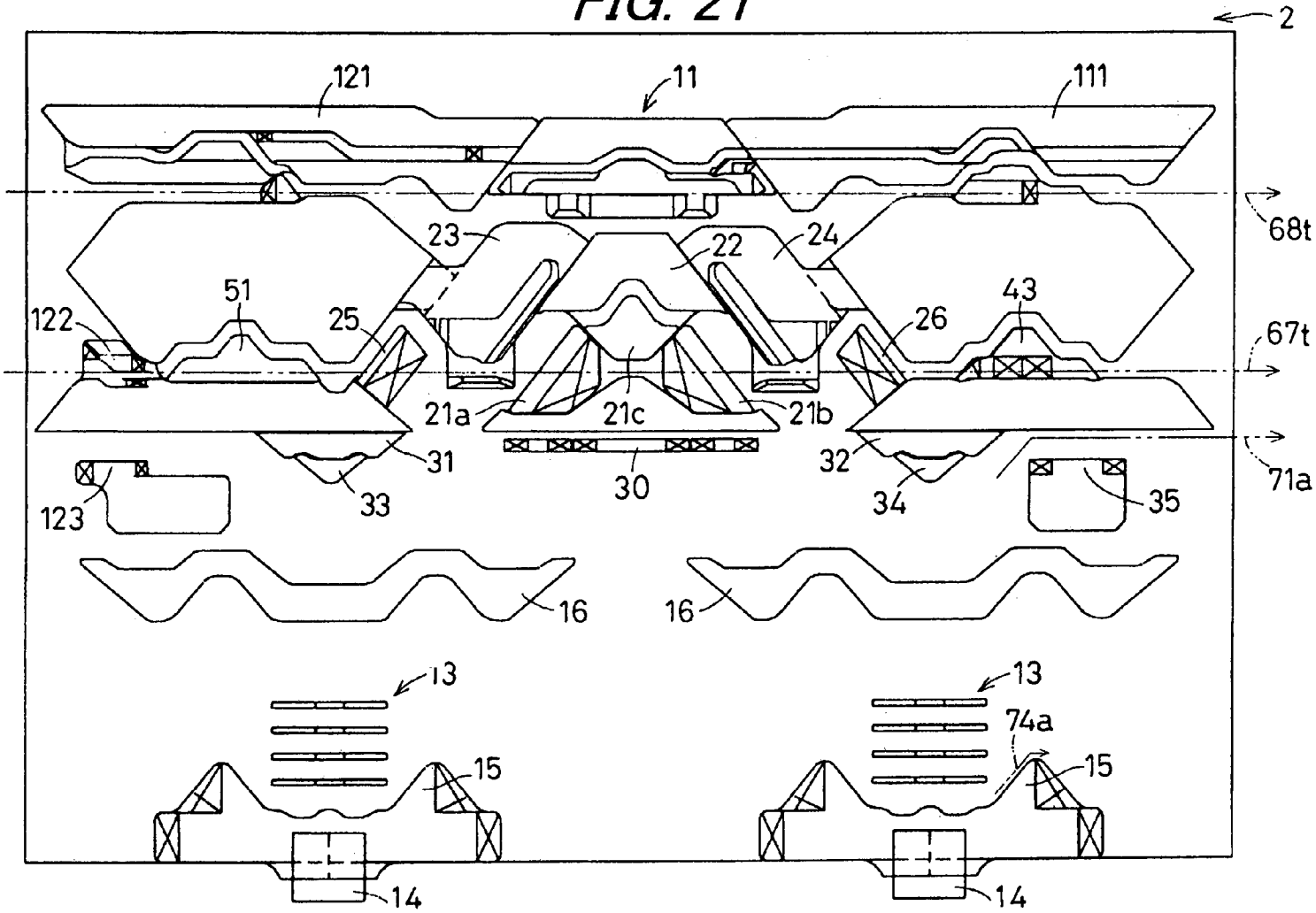
FIG. 21 is a cam layout showing a control state for preparing for return of the knitted loop after the continued holding, having the carriage 103 in FIG. 9 facing the carriage in FIG. 20.

FIGS. 18 and 19 show control states for keeping the holding further. From the carriage 104 shown in FIG. 18 on the receiving side where the holding is performed on the slider 64, the select jack stitch cam 33 is made to protrude. The needle jack butt 67 shown in the path 67*r* at the previous step in FIG. 17 lowers from the path 67*a* to the path 67*c* along the lowering face 122*a* of the needle jack guide cam 122 from outside of the carriage 104 on the receiving side so that the needle jack butt 67 is sank by the pressing slope 122*b*. At this time, the slider butt 68 is also sank simultaneously, resulting in no more reception of the action of the receiving slider cam 121. Furthermore, the select jack butt 71 is pushed down to the position B by the select jack stitch cam 33 as shown by the path 71*c* and retained in the path 71*c*. Accordingly, the slider butt 68 keeps a position thereof as shown by the path 68*c* at which position the tongue 64*a* of the slider 64 has advanced toward the needle bed gap 2. On the other hand, on the carriage 103 on the transfer side shown in FIG. 19, the select jack butt 71 is pushed down to the position B by the select jack stitch cam 34 as shown by the path 71*c* and retained in the path 71*c*, enabling the holding to continue as shown at the circulated symbol g in FIG. 15.

Figure 22:
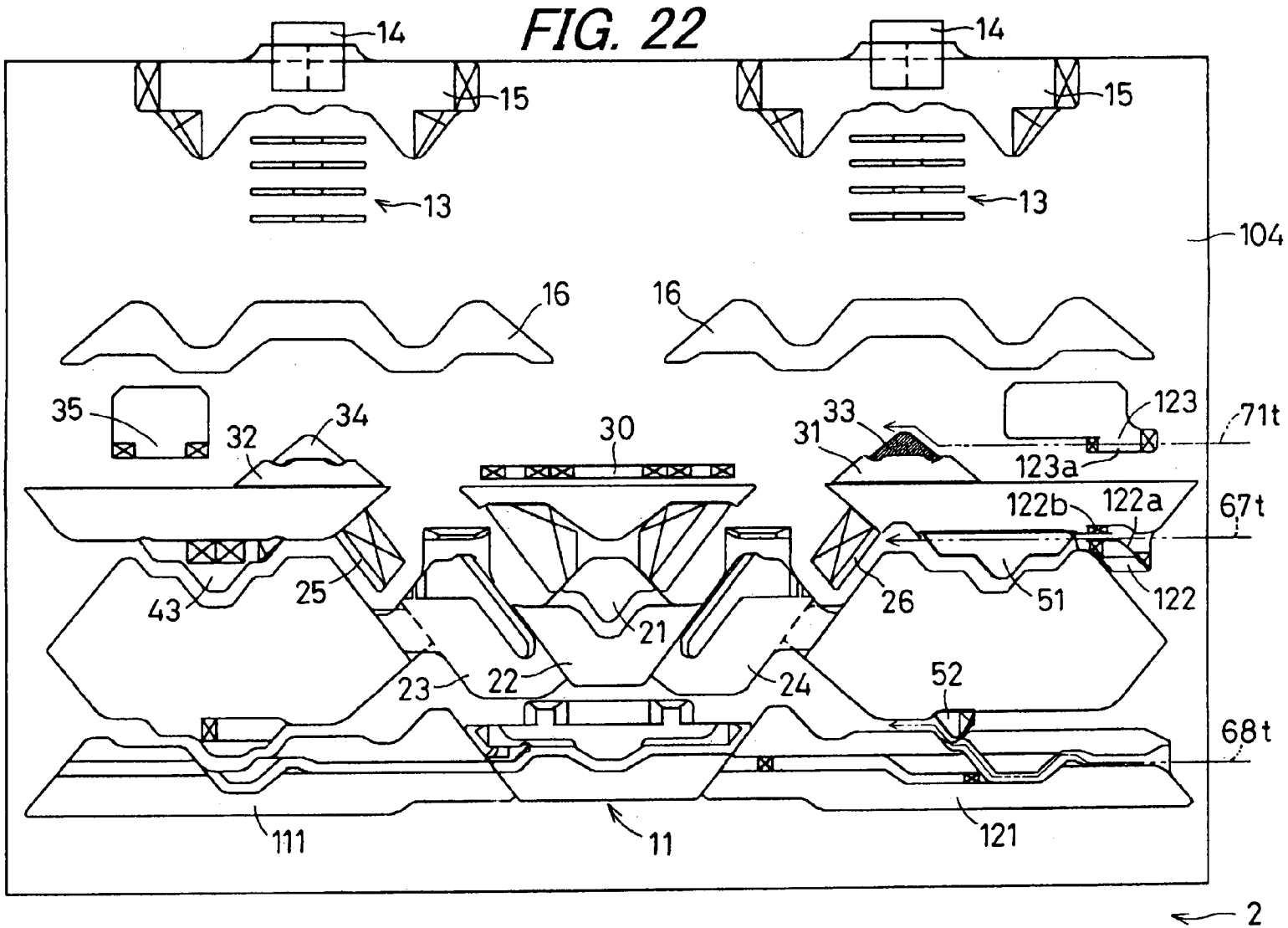
FIG. 22 is a cam layout showing a control state for transferring a to-be-returned knitted loop after the continued holding, having the carriage 104 in FIG. 9 facing the carriage in FIG. 23.
Figure 23:
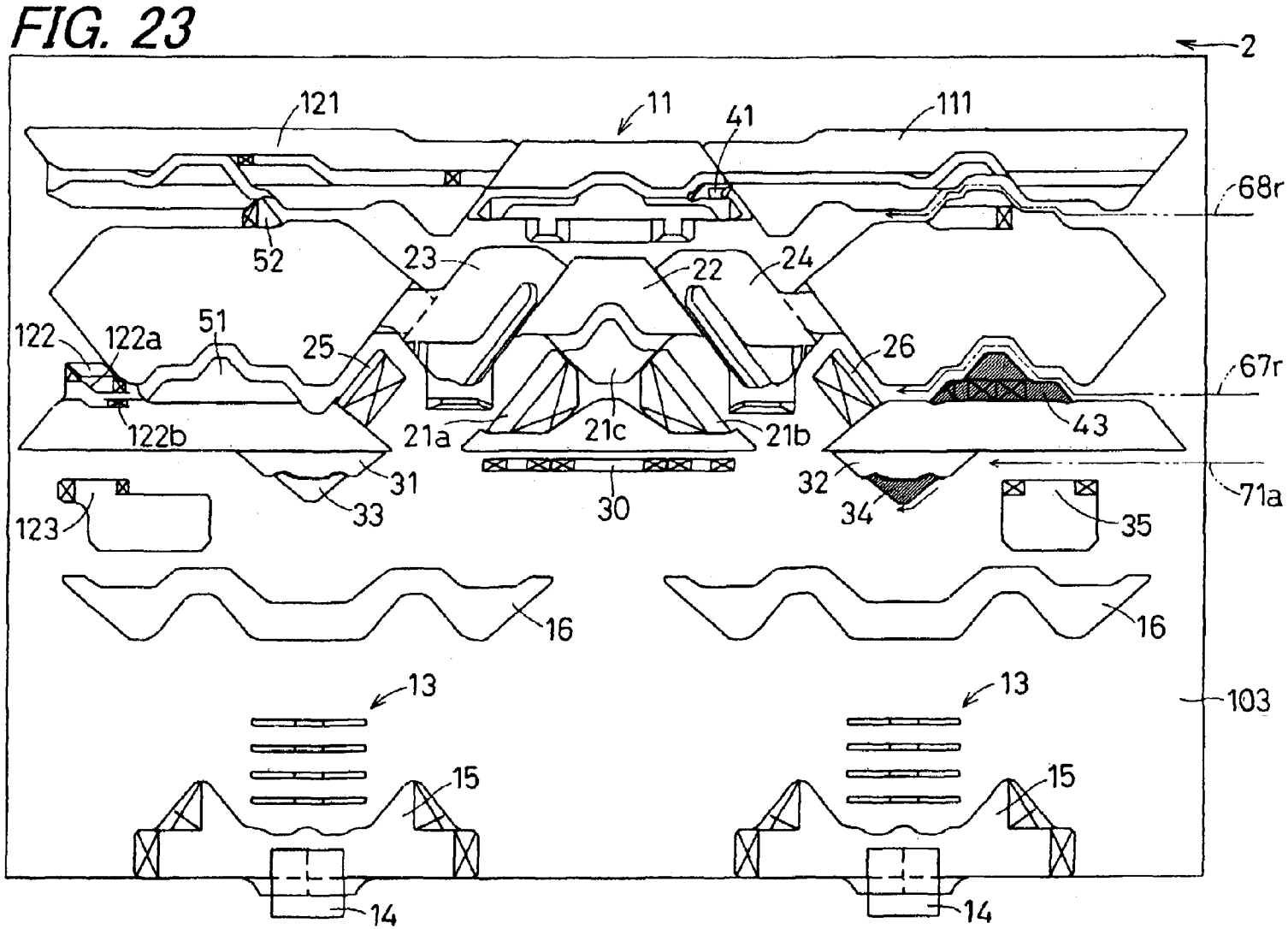
FIG. 23 is a cam layout showing a control state for receiving the to-be-returned knitted loop after the continued holding, having the carriage 103 in FIG. 9 facing the carriage in FIG. 22.

FIGS. 20, 21, 22 and 23 show states of returning the knitted loop to the needle hook 63*a* after the continued holding. From the carriage 104 on the receiving side where the holding is performed on the slider 64, the movable presser 30 (30*a*, 30*b*, and 30*c*) is made to protrude in a leftward course shown in the FIGS. 20 and 21 while the return is to be carried out in a rightward course shown in FIGS. 22 and 23 and at the same time, the selector 72 is selected by the preceding needle selection actuator 13 so that the select jack butt 71 of the select jack 70 is pushed up to the position A as shown by the path 71*a*. After the select jack butt 71 has passed through a section in abutment with the movable presser 30 (30*a*, 30*b*, and 30*c*), the slider butt 68 engages with a cam groove of the receiving slider cam 121 as shown by the path 68*a* and keeps a position where the tongue 64*a* of the slider 64 has advanced toward the needle bed gap 2. Moreover, the select jack butt 71 which has passed through the movable presser 30 (30*a*, 30*b*, and 30*c*), is made to lower to the position H along the select jack half stitch cam 31. In FIG. 22, similarly to FIG. 13, the carriage 104 which had been on the receiving side is now on the transfer side, and the select jack butt 71 at the position H shown in the path 71*h* is pressed into a section where the holding presser 123 is provided, so as to pass through the path 67*t* from the outside without being made to engage with the needle jack guide cam 122. After this, the slider butt 68 can engage with the receiving slider cam 121. In FIG. 23, similarly to FIG. 14, the carriage 103 which had been on the transfer side is now on the receiving side, and the needle body 63 is made to advance toward the needle bed gap 2 by the transfer-side knitted loop receiving cam 43 so that the knitted loop is returned. Accordingly, the steps regarding FIGS. 22 and 23 are the same as the process shown in the circulated symbol K to the circulated symbol P in FIG. 15.

As described above, according to each of the embodiments, the knitted loop 80 can be transferred from the group of transfer cams 40 or 110 to the group of receiving cams 50 or 120, and the transferred knitted loop 80 can be retained. As to the retention of the knitted loop 80 at the receiving side, it is also possible to perform the holding that the transferred knitted loop 80 is retained on the tongue 64*a* of the slider 64 while retaining the knitted loop 80 on the needle body 63 during knitting.

Moreover, the transferring can be freely carried out between the front and rear needle beds, and it is possible to temporarily place the knitted loop 80 from one needle bed to the other needle bed and keep the holding, and what is more, retain the knitted loop 80 separately from the fabric being knitted on the other needle bed and when needed, return the knitted loop 80 from the other needle bed to the one needle bed. Without providing auxiliary needle beds such as an upper bed nor an idle needle, it is possible to knit a variety of fabrics by use of transferring for a tubular fabric and a rib fabric and further, a tubular fabric having such a knitted texture that knitted loops are crossed each other, and fashioning fabric and the like.

Moreover, the needle selection mechanism 12 can conduct various controls at three positions, and it is possible to simplify the needle selection mechanism 12 and even when various needle selections can be conducted, the carriages 3 and 4; 103 and 104 can be downsized. The downsizing of the carriages 3 and 4; 103 and 104 enables an increase in speed of movement and shortening of moving distance, so that it is possible to knit a fabric having a narrow width including a glove with a high efficiency.

The invention may be embodied in other specific forms without departing from the spirit or essential characteristics thereof. The aforementioned embodiments are therefore to be considered in all respects as merely illustrative, and the scope of the invention is not restricted by the description itself, but indicated by the scope of claims. Furthermore, all modification and changes which come within the scope of claims are embraced in the range of the invention.

INDUSTRIAL APPLICABILITY

According to the invention, it is possible to make a carriage be downsized with a simple structure and transfer a knitted loop from a group of transfer cams to a group of receiving cams, and retain the transferred knitted loop, by separately disposing a route for a knitting cam and a route for transferring, and coordinating these routes each other. As to retention of the knitted loop at a receiving side, it is also possible to retain the transferred knitted loop on a tongue of a slider while retaining the knitted loop on a needle body during knitting. In a knitting course including no transferring, a carriage can be made to move back and forth in such a narrow stroke that a knitting cam merely passes through predetermined knitting needles while only in a course including transferring, a carriage can be made to move back and forth in a stroke which is wide enough for the group of transfer cams to pass through the needles, so that a time loss can be eliminated to increase a knitting efficiency.

Further, according to the invention, it is possible to perform transferring and knitting operations by back-and-forth movements of carriages while retaining a state where a knitted loop is hooked on a tongue of a slider, without impairing a small size of the carriage. Accordingly, knitting variations become abundant because it is possible to knit a knitted texture having knitted loops crossed each other like a cable stitch onto pouched fabric such as a glove without providing an idle needle.

Further, according to the invention, transferring can be freely carried out between front and rear needle beds, and it is possible to temporarily place a knitted loop from one needle bed to the other needle bed, and what is more, retain the knitted loop separately from a fabric being knitted on the other needle bed and when needed, return the knitted loop from the other needle bed to the one needle bed. Without providing auxiliary needle beds such as an upper bed nor an idle needle, it is possible to knit a variety of fabrics by use of transferring for a tubular fabric and a rib fabric, and fashioning fabric and the like.

Further, according to the invention, it is possible to simplify a needle selection mechanism and even when various needle selections can be conducted, a carriage can be downsized.

The invention claimed is:

1. A cam apparatus for knitting a fabric in a weft knitting machine having front and rear needle beds facing each other at a needle bed gap, the cam apparatus comprising:

a knitting cam mounted on a carriage moving along each of the needle beds, to act on a needle body of each of compound needles arranged side by side in each of the needle beds; and a slider cam mounted on a side of the carriage facing the needle bed gap, to act on a butt of a slider and to drive an operation of knitting a fabric so that the slider is cooperated with the needle body driven by the knitting cam, wherein the cam apparatus includes a group of transfer cams provided in series with respect to the knitting cam on at least one of the carriages, and a group of receiving cams provided in series with respect to the knitting cam on at least one of the carriages, which is opposed at the needle bed gap to the carriage provided with the group of transfer cams, the group of transfer cams including:

a slider transfer raising cam, disposed at an ending position of a cam route through which the butt of the slider is guided by the slider cam, the slider transfer raising cam being capable of controlling a change-over between driving and non-driving of the butt of the slider, wherein during the change-over to drive the slider, the slider transfer raising cam guides the butt of the slider and moves further to convey the slider to a cam route in which a tongue of the slider advances towards the needle bed gap than a hook of the needle body; and a transfer cam, disposed on the cam route to which the butt of the slider is guided by the slider transfer raising cam to drive the slider to advance to a transfer position where a knitted loop can be transferred at a farther advanced position towards the needle bed gap than a position advanced by the slider cam, and the group of receiving cams including:

a transfer-side knitted loop receiving cam disposed at a position facing the transfer cam of the group of transfer cams, the transfer-side knitted loop receiving cam being capable of controlling a change-over between driving and non-driving of the needle body, wherein during the change-over to drive the needle body, the transfer-side knitted loop receiving cam drives the needle body and moves to convey a hook of the needle body to a knitted loop receiving position where a knitted loop can be received from the slider advancing to the transfer position by the transfer cam; and a slider receiving raising cam disposed in a vicinity of a position where the driving of the needle body is started by the knitted loop receiving cam, the slider receiving raising cam being capable of controlling a change-over between driving and non-driving of the butt of the slider, wherein during the change-over to drive the butt of the slider, the slider receiving raising cam guids the butt of the slider and moves further to convey the slider to a receiving retention route for retaining the knitted loop in which a tongue of the slider advances towards the needle bed gap than a hook of the needle body, wherein the group of transfer cams further include a transfer-side knitted loop transfer cam disposed at a position facing a receiving retention route through which the slider is guided by the receiving raising cam of the group of receiving cams, the transfer-side knitted loop transfer cams being capable of controlling a change-over between driving and non-driving of the needle body, and conveying the hook of the needle body independently or together with the slider to the knitted loop receiving position when carrying out the change-over to drive the needle body.

2. The cam apparatus of claim 1, wherein the compound needle is provided with a needle jack so as to be driven by the knitting cam to perform a knitting operation; and the butt of the slider is provided to move into a needle groove and not be subjected to a driving operation from the group of receiving cams by moving the needle jack into the needle groove;

the cam apparatus further comprising a needle jack guide cam and a presser, the needle jack guide being provided in series to the group of receiving cams and extends outwardly from the knitting cam, the needle jack guide cam including a pressing slope for pressing a butt of the needle jack so as to move the butt of the slider into the needle groove, and a cam face for guiding the butt of the needle jack to the pressing slope so that the butt of the slider passes through the group of transfer cams, the presser being selectively capable of pressing the needle jack so as to pass the needle jack without engaging with the cam face of the needle jack guide cam.

3. The cam apparatus of claim 1, wherein the group of transfer cams and the group of receiving cams are respectively provided on the carriages which are respectively disposed on the front and rear needle beds.

4. The cam apparatus of claim 1, wherein each of the carriages includes the knitting cam to execute at least one knitting operation, each of the carriages further comprising:

a needle selection mechanism disposed on two sides of the knitting cam with respect to a moving direction of the carriage, the needle selection mechanism performing a needle selection operation for selecting a needle to one position among three different control positions; and a movable presser disposed at one of the three positions, the movable presser being capable of controlling the knitting operation.

* * * * *